US012687028B2

(12) United States Patent
Haeberle

(10) Patent No.: US 12,687,028 B2
(45) Date of Patent: Jul. 21, 2026

(54) FORMWORK PANEL

(71) Applicant: PERI SE, Weissenhorn (DE)

(72) Inventor: Wilfried Haeberle, Langenau (DE)

(73) Assignee: PERI SE, Weissenhorn (DE)

( * ) Notice: Subject to any disclaimer, the term of this patent is extended or adjusted under 35 U.S.C. 154(b) by 154 days.

(21) Appl. No.: 18/309,528

(22) Filed: Apr. 28, 2023

(65) Prior Publication Data

US 2023/0349175 A1 Nov. 2, 2023

(30) Foreign Application Priority Data

Apr. 28, 2022 (DE) ..... 10 2022 110 434.6

(51) Int. Cl.
*E04G 17/16* (2006.01)
*E04G 9/02* (2006.01)

(52) U.S. Cl.
CPC ..... *E04G 17/16* (2013.01); *E04G 9/02* (2013.01)

(58) Field of Classification Search
CPC .. E04G 2011/067; E04G 19/003; E04F 11/00; E04F 11/06; E04F 11/08
See application file for complete search history.

(56) References Cited

U.S. PATENT DOCUMENTS 2,341,993 A * 2/1944 Jennings ..... E04G 9/02 249/189
4,795,136 A * 1/1989 Haefner ..... B66C 23/208 425/63
5,694,668 A 12/1997 Rohlf
6,767,154 B1 * 7/2004 Schwoerer ..... E04G 17/045 403/324
8,002,240 B1 * 8/2011 Wilson, Sr. ..... B66C 1/16 254/335

FOREIGN PATENT DOCUMENTS

| | | | | |
|---|---|---|---|---|
| DE | 3604252 | * | 8/1987 | |
| DE | 102020123075 | A1 | 3/2022 | |
| EP | 3947855 | A1 * | 2/2022 | ..... E04G 9/04 |
| ES | 2302479 | A1 | 7/2008 | |
| FR | 2921272 | A1 | 3/2009 | |
| WO | 2021148232 | A1 | 7/2021 | |

* cited by examiner

*Primary Examiner* — Jessica L Laux
(74) *Attorney, Agent, or Firm* — SLEMAN & LUND LLP

(57) ABSTRACT

A formwork panel, comprising a frame on the front side of which a formwork shell can be fixed. The frame has a plurality of longitudinal struts and a plurality of transverse struts running plane-parallel to one another. The longitudinal struts and the transverse struts are arranged substantially perpendicular to one another. Between at least two transverse struts running adjacent to one another, there is arranged at least one bridging element having an arc-shaped design. The bridging element has two end regions, one of the end regions being fixed in each case to one of the adjacent transverse struts.

21 Claims, 25 Drawing Sheets

FORMWORK PANEL

CROSS-REFERENCE TO RELATED APPLICATIONS

This application claims priority to the filing date of German patent application number 10 2022 110 434.6, filed on Apr. 28, 2022, the disclosure of which is hereby incorporated by reference.

FIELD

The invention relates to a formwork panel comprising a frame to the front side of which a formwork shell can be fixed, wherein the frame comprises a plurality of longitudinal struts and a plurality of transverse struts running plane-parallel to one another, wherein the longitudinal struts and the transverse struts are arranged substantially perpendicular to one another.

The invention also relates to a bridging element for use in a formwork panel.

BACKGROUND

Formwork panels are used as parts of formwork systems, in particular for the production of components. The formwork panels are here arranged in such a way that they form a mold into which a hardenable building material, i.e., an initially liquid and then hardening building material, mostly concrete, is introduced for the production of a component, for example a wall element. After hardening of the building material, the formwork panels are generally removed. The formwork panel has a frame on the front side of which a formwork shell can be fixed, i.e., is attachable or attached.

The frame has a plurality of longitudinal struts and a plurality of transverse struts running plane-parallel to one another. The longitudinal struts and the transverse struts are here arranged substantially perpendicular to one another, or run perpendicular to one another.

On the one hand, the frame of the formwork panel should be stable in order to be able to bear the loads occurring when filling the formwork system with hardenable concrete. On the other hand, the frames should be sufficiently rigid to ensure high dimensional accuracy and to avoid unwanted deformation.

The structure of a surface of the concrete component facing the formwork shell is determined by the formwork shell attached to the frame. A front side of the formwork shell faces the concrete to be filled, i.e., the front side of the formwork shell forms the concrete-contacting surface, while the rear side of the formwork shell is attached to the frame.

It is known from the general prior art that two formwork panels are positioned opposite to each other at a distance, so that concrete can be poured between the formwork panels located opposite one another (usually as first panel and as closing panel). The formwork panels are connected and braced together by rods, commonly designated as anchor rods.

A generic formwork panel is known from WO 2021 148232 B1.

In the production of high walls or wall elements, a scaffold is generally required in order to position the formwork panels relative to one another and to connect them to one another in such a way that a formwork suitable for producing the wall element is provided. A scaffold is required on the one hand to connect individual formwork panels to one another for the overall formwork or a circuit system, for example by attaching formwork locks. Furthermore, two opposing formwork panels must be connected to one another before the production of a wall element, as described above, by means of anchors in order to absorb the outwardly acting pressure of the cast concrete material. For this purpose, the formwork panels must be accessible to workers over their entire height, for which purpose a scaffold or working platform is usually used. Furthermore, in most cases, prior to the manufacture of the wall element, a reinforcement has to be provided between a first formwork and a closing formwork, which is opposite the first formwork.

In order to support a safe state of the formwork panels, in particular so that the formwork panels can absorb the outwardly-acting pressure of the cast concrete material, it is known from the prior art to support the formwork panels with push-pull props.

Both in the positioning of the individual formwork panels and in the construction of the formwork system or for the formation of a total formwork and also when constructing a scaffold, a working platform or when attaching a push-pull prop, it is advantageous if the worker can easily handle the formwork panel, or bring it into position. For this purpose, it can be advantageous if the formwork panel has handles, a climbing strut or, generally, docking points, e.g., for protective equipment.

SUMMARY

The object of the present invention is to improve the formwork panels known from the prior art, in particular to facilitate the handling of the formwork panels in order to improve the construction of a formwork system, in particular also in cooperation with a scaffold and/or with push-pull props.

This object is achieved by a formwork panel, comprising a frame on the front side of which a formwork shell can be fixed, wherein the frame has a plurality of longitudinal struts and a plurality of transverse struts running plane-parallel to one another, wherein the longitudinal struts and the transverse struts are arranged substantially perpendicular to one another, and wherein at least one bridging element is arranged between at least two transverse struts running adjacent to one another, wherein the bridging element has two end regions and one of the end regions is in each case fixed to one of the two adjacent transverse struts.

The formwork panel according to the invention has a frame on the front side of which a formwork shell is fixable, in particular attachable or attached. The frame of the formwork panel has a plurality of longitudinal struts and a plurality of transverse struts running plane-parallel to one another. The longitudinal struts and the transverse struts are arranged substantially perpendicular to one another, or run perpendicular to one another.

According to the invention, it is provided that at least one arc-shaped bridging element is arranged between at least two transverse struts running adjacent to one another. The bridging element here has two end regions, one of the end regions in each case being fixed to one of the two adjacent transverse struts.

It is advantageous if the end regions are each fixed directly to the respectively associated transverse strut. However, for the fixing of the end regions to the respective transverse strut, an additional connecting profile can also be provided, which connects the respective end region to the respectively assigned transverse strut. However, a direct fixing of the end regions to the respectively associated transverse strut is advantageous.

The arc-shaped bridging element can be used in a variety of ways. The arc-shaped bridging element simplifies the handling of the formwork panel in an ergonomically advantageous manner. With the aid of the arc-shaped bridging element, the formwork panel can be transported and positioned more easily.

The bridging element can, insofar as this is legally permissible in the respective jurisdictions, also advantageously serve as a handle and/or as a climbing aid or as a climbing strut, in particular in connection with a scaffold positioned adjacent to or on the formwork panel.

The arc-shaped bridging element can in particular be an arc-shaped handle.

The arc-shaped design of the bridging element makes it possible in a particularly advantageous manner for a worker to grasp the bridging element.

Furthermore, insofar as this is legally permissible in the respective jurisdictions, the bridging element can also be used to attach protective equipment, e.g. to dock a so-called self-locking snap.

The bridging element according to the invention can further increase the stiffness of the entire formwork panel.

The bridging element has also turned out to be advantageous in the case of formworks that are in a lying position, which subsequently have to be positioned upright.

It is advantageous if at least two, preferably exactly two, arc-shaped bridging elements are arranged at the same vertical height when the formwork panel is used as intended. As a result, the arc-shaped bridging element can be used in a particularly suitable manner as a handle or as a climbing aid. Preferably, the formwork panel has two or more such pairs of bridging elements which are arranged at different vertical heights of the formwork panel. Preferably, here it can be provided that a first pair of bridging elements is fixed in a lower third of the height of the formwork panel. A second pair of bridging elements can here be fixed in an upper third of the formwork panel. In addition, it can be provided that a third pair of bridging elements is arranged in the region of the center of the formwork panel in relation to the vertical extension of the formwork panel in the case of an arrangement as intended.

The inventor has found that a bridging element in the shape of an arc is particularly advantageously fixable to the transverse struts, since through the arc-shaped profile, as compared with a bridging element extending only orthogonally between the transverse struts, a larger contact region for fixing, e.g., for welding, can be formed on the transverse struts.

It is advantageous if the bridging element is designed and fixed to the transverse struts in such a way that a handling region of the bridging element formed between the end regions has a greater distance from the front side of the frame than the two end regions of the bridging element which are fixed to the transverse struts.

The handling region of the bridging element, which is located between the end regions of the bridging element, can be designed as a gripping region for the hand of a worker, in particular if the bridging element is a handle and/or a climbing aid or a climbing strut.

As a result of the fact that the bridging element is designed and fixed to the transverse struts in such a way that the handling region has a greater distance from the front side of the frame and thus from the rear side of a formwork shell fixed there than do the two end regions, fixed to the transverse struts, of the bridging element, the handling region can be grasped particularly advantageously by the hand of a worker.

According to the invention, it can further be provided that the arc-shaped design of the bridging element results from the fact that the bridging element between the end regions has, at least in sections, a profile that is curved and/or arc-shaped and/or is inclined with respect to the longitudinal struts.

The bridging element can be designed such that it has a uniform arc-shaped or curved profile between the end regions. However, the bridging element can also be designed in such a way that the arc-shaped profile results from the fact that the bridging element is composed of a plurality of arc-shaped elements or sections and/or straight elements or sections, so that an arc-shaped profile results overall for the bridging element.

The bridging element can also be designed such that it has only two arc-shaped or bent sections or only four arc-shaped or bent sections and one or three substantially linear or straight sections. Insofar as more than one linear section is present, it can be provided that one or more of the linearly running sections are arranged in such a way that they have an inclined course with respect to the longitudinal struts, i.e., do not run vertically when the formwork panel is used as intended, or is used in such a way that the longitudinal struts extend in a vertical direction and the transverse struts extend in a horizontal direction.

It is advantageous if the arc-shaped design of the bridging element results from the fact that a central region comprising the handling region of the bridging element, which extends between the two end regions fixed to the transverse struts, is arc-shaped.

It can be provided that the central region of the bridging element, which comprises the handling region, is arc-shaped or curved over the entire course. However, it can also be provided that the arc-shaped design of the central region results from the fact that the central region has bent sections and linear or straight sections.

According to the invention, it can further be provided that at least one central section of the handling region runs parallel to the longitudinal struts.

It has been found to be particularly suitable if a central section of the handling region, in particular when it is designed as a gripping region of a handle, runs parallel to the longitudinal struts. Thus, the central section extends in a vertical direction when the formwork panel is used as intended, whereby a worker can particularly advantageously grip the handling region. The bridging element, in particular in a design as a handle, thus makes it possible, on the one hand, for an advantageous distance to the front side of the frame to be present in order to grip the handle and, on the other hand, for a straight and vertically running section to be present that can be grasped particularly well by the hand of a worker.

Preferably, the entire handling region runs parallel to the longitudinal struts.

It is advantageous if the bridging element is formed symmetrically starting from the end regions.

A symmetrical design of the bridging element starting from the end regions has been found to be particularly suitable.

According to the invention, it can further be provided that the bridging element is designed as a tube, preferably with at least one moisture outlet opening in a section adjoining the end region, and/or as a longitudinally cut tube and/or as a bent flat material and/or as a preferably solid rod.

By forming the bridging element as a tube, the bridging element can be produced particularly cost-effectively and easily. As a result of the formation of moisture outlet openings in a section of the tube adjoining the end region, it is also possible to achieve that moisture, in particular rainwater, can run off from the interior of the tube. This prevents water from standing in the tube. By forming a correspondingly suitable number of moisture outlet openings, it can be achieved that the water can also run out of the tube in a tilted state.

In a particularly advantageous embodiment, it can be provided that the bridging element is designed as a longitudinally cut tube and/or as a bent flat material.

The production of a bridging element made of a longitudinally cut tube and/or of a bent flat material makes it possible to produce the bridging element particularly ergonomically, preferably such that it does not have any sharp edges. Furthermore, production of the bridging element from a longitudinally cut tube and/or from a bent flat material has the result that liquid, in particular water, can run out of the bridging element in an ideal manner and no water remains standing in the bridging element.

It has further been shown that the end regions, when the bridging element is produced from a longitudinally cut tube and/or from a bent flat material, can particularly advantageously be fixed, e.g., welded, to the transverse struts.

The flat material for producing the bridging element can, for example, be punched out or laser-cut from a flat material and subsequently bent accordingly.

The bridging element, in particular when it is produced from a flat material, can preferably have a U-shaped profile when viewed in cross-section. A U shape makes it possible to achieve a high stiffness, which can be advantageous for example when protective equipment is to be fixed to the bridging element.

The bridging element can also be produced by forging, or the bridging element can be a forged part.

According to the invention, it can be provided that the end regions are connected, preferably riveted, screwed, and/or welded, to the transverse struts in a positive-fitting, non-positive-fitting, and/or materially bonded manner.

In particular, welding of the end regions to the transverse struts has proven to be particularly advantageous. For this purpose, it can be provided that each end region is welded to the transverse strut with two weld seams that preferably run linearly.

It has been shown that the end regions can be welded particularly advantageously on both sides and thus a reliable welded connection can be formed.

It is advantageous if the transverse struts each have an upper side and a lower side which extend substantially orthogonally to the front side of the frame, wherein an upper end region of the bridging element is fixed to the lower side of an upper transverse strut of the two transverse struts and a lower end region of the bridging element is fixed to the upper side of a lower transverse strut of the two transverse struts.

Fixing the bridging element on an upper side or a lower side of the transverse struts, which extend substantially orthogonally to the front side of the frame or which extend orthogonally to a surface of the formwork shell, when a formwork shell is fixed on the front side of the frame, has proven to be particularly suitable for simply and reliably fixing, preferably welding, the bridging element. Here an upper region of the bridging element is preferably fixed or welded to the lower side of an upper transverse strut. A lower end region of the bridging element is correspondingly fixed or preferably welded to the upper side of a lower transverse strut of the two transverse struts.

According to the invention, it can be provided that at least a part of the transverse struts has, in each of the upper side and the lower side, at least one groove which runs in the longitudinal direction of the transverse struts.

In cross-section, the profile of the transverse struts can preferably have the shape of a bone or an "H." With the aid of the grooves, different scaffolds, platforms, and/or props, in particular push-pull props, can be easily and securely attached to the formwork panel, for example by means of a connecting component, e.g., a clamping device. The connecting component, which preferably comprises gripping devices or grippers adapted to the profile, can be variably attached to and removed from the frame. Thus, scaffolds, platforms, and/or supports, in particular push-pull props for aligning the formwork, can be flexibly attached.

It has been found to be particularly suitable for the grooves to extend over the entire length of the respective transverse strut. In this way, connecting components, e.g., clamping devices, can be particularly advantageously and flexibly fixed to the frame.

According to the invention, it can further be provided that the grooves in the upper sides and the lower sides of the respective transverse struts run off-center such that the grooves run closer to a rear side of the frame than to the front side.

Preferably, the grooves in the upper side and the lower side run with a constant or uniform distance from the edges of the upper side or the lower side of the transverse strut.

Preferably, the grooves run off-center in the upper side or the lower side of the transverse struts in such a way that the grooves have a greater distance to a front edge of the transverse strut, in which the upper side or the lower side adjoins the front side of the frame or the formwork shell, than to the respective rear edge of the transverse strut, which adjoins the rear side of the frame. Because the grooves run off-center in this way, a connecting component, or clamping device, can be particularly advantageously fixed in the grooves.

It is also advantageous if the transverse struts have holes spaced from the grooves in the upper side and/or the lower side, which holes preferably serve for draining liquids, for example rainwater. It has been found to be advantageous if side walls of the respective grooves are inclined outwards from a groove base of the respective grooves, wherein the side walls can preferably enclose an angle with the groove base of 95° to 125°, in particular 110°.

The grooves can preferably have a depth of 9 mm to 16 mm, preferably of 13 mm.

The inventor has recognized that by means of this geometry connecting components can be fixed in the grooves in a particularly simple and rotationally secure manner, preferably by clamping.

The bridging element according to the invention has proven to be particularly advantageous in connection with transverse struts, which have in the upper side and the lower side respectively at least one groove running in the longitudinal direction of the transverse struts, in particular as described above. Particularly in the case of a particularly advantageous embodiment of the transverse struts with grooves which run off-center in such a way that the grooves have a greater distance from a front edge of the transverse strut, the arc-shaped course of the bridging element is particularly suitable. Due to the arc-shaped course of the bridging element, it is possible to define the bridging element in a section of the upper side or the lower side of the transverse struts which do not have a groove. These sections adjoin the front side of the frame. A formation of the bridging element with a linear course would have the disadvantage that a hand of the worker cannot suitably or easily grasp the bridging element due to the spatial proximity to the front side of the frame and thus also to the formwork shell. The arc-shaped design of the bridging element solves this problem in an advantageous manner.

According to the invention, it can be provided that the grooves, viewed in the cross section of the respective transverse strut, are arranged axially symmetrically to one another and/or are arranged opposite one another, and/or the grooves have at least approximately the same shape when viewed in the cross section of the respective transverse strut. It is advantageous if the grooves extend at least over a partial length or over the entire length of the respective transverse strut and the grooves run at a uniform distance from the front side of the frame in the transverse struts.

According to the invention, it can further be provided that the end regions of the bridging element are fixed to sections of the upper side and the lower side which are located between the grooves and the front side of the frame, wherein preferably the ends of the bridging element lie in a plane with the front side of the frame.

Due to the fact that the ends of the bridging element preferably lie in a plane with the front side of the frame, i.e., preferably adjoin a formwork shell or end directly in front of the formwork shell, a particularly large area is provided in order to fix the ends of the bridging element to the transverse struts, preferably to weld them there.

According to the invention, it can further be provided that the frame has two outer frame transverse struts and two outer frame longitudinal struts, between which inner transverse struts are arranged, the bridging element being arranged between two of the inner transverse struts.

It has proven to be particularly suitable for the bridging element to be arranged between two of the inner transverse struts. Such positioning is advantageous in particular when the bridging element serves as a handle or as a climbing aid.

According to the invention, it can further be provided that all inner transverse struts have the grooves and the outer frame transverse struts do not have grooves.

It has been found to be sufficient if all inner transverse struts have grooves. The additional formation of grooves also on the outer frame transverse struts can therefore also be omitted for reasons of cost.

It is advantageous if the end regions of the bridging element are designed such that the end regions extend substantially orthogonally to the front side of the frame, adjacent to the respective upper side or the respective lower side of the transverse strut.

A design of the end regions, such that the contact surfaces of the end areas with which they are fixed, in particular welded, to the transverse struts extend orthogonally to the front side of the frame, has proved particularly suitable for fixing the bridging element in a stable and secure manner.

It is advantageous if at least two bridging elements, preferably exactly two bridging elements, are arranged between the two transverse struts.

It has been found to be particularly suitable if at least two bridging elements are arranged and fixed between two transverse struts, i.e. a transverse strut pair. Such a configuration simplifies handling and positioning of the formwork panel and also has advantages when the bridging elements are to be used as hand grips and/or climbing aids.

It is advantageous if at least two transverse strut pairs, preferably three transverse strut pairs, are provided, each consisting of two transverse struts running adjacent to one another, wherein at least one bridging element, preferably at least two bridging elements, in particular exactly two bridging elements, are arranged between the two transverse struts of each transverse strut pair.

Because the formwork panel has at least two transverse strut pairs, preferably three transverse strut pairs, the formwork panel can be handled particularly advantageously, because this design ensures that at least one bridging element is always suitably reachable by the worker.

According to the invention, it can further be provided that at least one transverse strut on which no bridging element is fixed is arranged in each case between two transverse strut pairs.

It has been shown to reduce the manufacturing costs that there can be arranged in each case between two transverse strut pairs at least one transverse strut, preferably exactly one transverse strut or two transverse struts, on which no bridging element is fixed and the formwork panel can nevertheless be handled advantageously.

In the context of the invention, it can be provided that a transverse strut is subdivided into two or more transverse strut parts by a longitudinal strut. Such a multi-part transverse strut is to be regarded as a transverse strut in the context of the invention. This applies in particular if all transverse strut parts run axially parallel to one another and thus, viewed functionally, form one transverse strut. In a particularly advantageous embodiment of the formwork panel, it can be provided that it has two longitudinal struts which form outer frame longitudinal struts and, if appropriate, an inner longitudinal strut is provided that runs centrally and plane-parallel to the frame longitudinal struts. This inner longitudinal strut can here divide the transverse struts into two transverse strut parts in each case.

The present invention also relates to a bridging element having an arc-shaped design for use in a formwork panel.

It is fundamentally advantageous if the formwork panel is already provided during production with the bridging elements according to the invention. However, it is also possible to attach the bridging elements subsequently, in particular to weld them in a suitable manner to the transverse struts, in order to retrofit existing or already delivered formwork panels.

BRIEF DESCRIPTION OF THE DRAWINGS

In the following, exemplary embodiments of the invention are described in their principle, with reference to the drawings.

The figures show the following.

DETAILED DESCRIPTION

Figure 1:
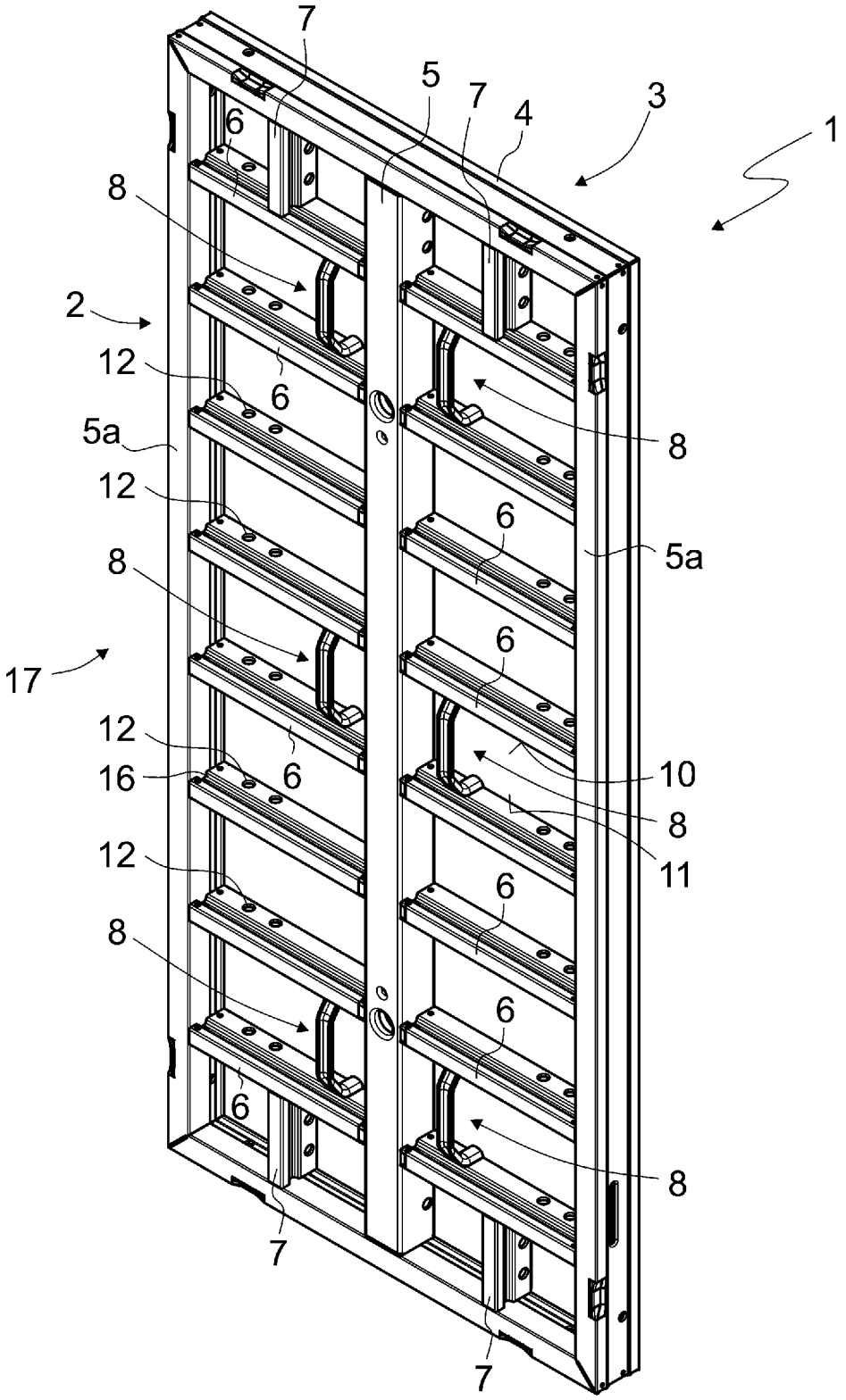
FIG. 1 a perspective view of the formwork panel according to the invention in a first embodiment.

Functionally identical elements are provided with the same reference numerals in the figures.

FIGS. 1 to 7 show a formwork panel 1, comprising a frame 2, on the front side 3 of which a formwork shell 4 is fixed or fixable.

The frame 2 has a plurality of longitudinal struts 5 and a plurality of transverse struts 6 running plane-parallel to one another. The longitudinal struts 5 and the transverse struts 6 are arranged substantially perpendicular to one another.

In the exemplary embodiment according to FIGS. 1 to 7, the frame 2 of the formwork panel 1 has three longitudinal struts 5 and ten transverse struts 6. Two of the longitudinal struts 5 are here designed as outer frame longitudinal struts 5*a*. Furthermore, two of the transverse struts 6 are designed as outer frame transverse struts 6*a*. The frame longitudinal struts 5*a* and the frame transverse struts 6*a* together form the outer perimeter of the frame 2.

Between the outer frame longitudinal struts 5*a* there is an inner longitudinal strut 5, which in the exemplary embodiment is positioned centrally between the two frame longitudinal struts 5*a*. Other embodiments are also possible here, in particular the arrangement of two or more inner longitudinal struts 5 or also the omission of the inner longitudinal strut 5.

In the exemplary embodiment, eight inner transverse struts 6 that run plane-parallel to one another are located between the two frame transverse struts 6*a*. The inner transverse struts 6 each preferably have an identical distance to adjacent further inner transverse struts 6.

In the exemplary embodiment, the transverse struts 6 are each divided by the longitudinal strut 5 into, in each case, two transverse strut parts. In the context of the invention, the transverse strut parts of a transverse strut 6 are regarded together as a transverse strut 6.

In the context of the invention, a different number of inner transverse struts 6 can also be realized; in particular it is advantageous if more than four inner transverse struts 6 are provided and fewer than fourteen, particularly preferably more than six and fewer than twelve inner transverse struts 6.

Figure 2:
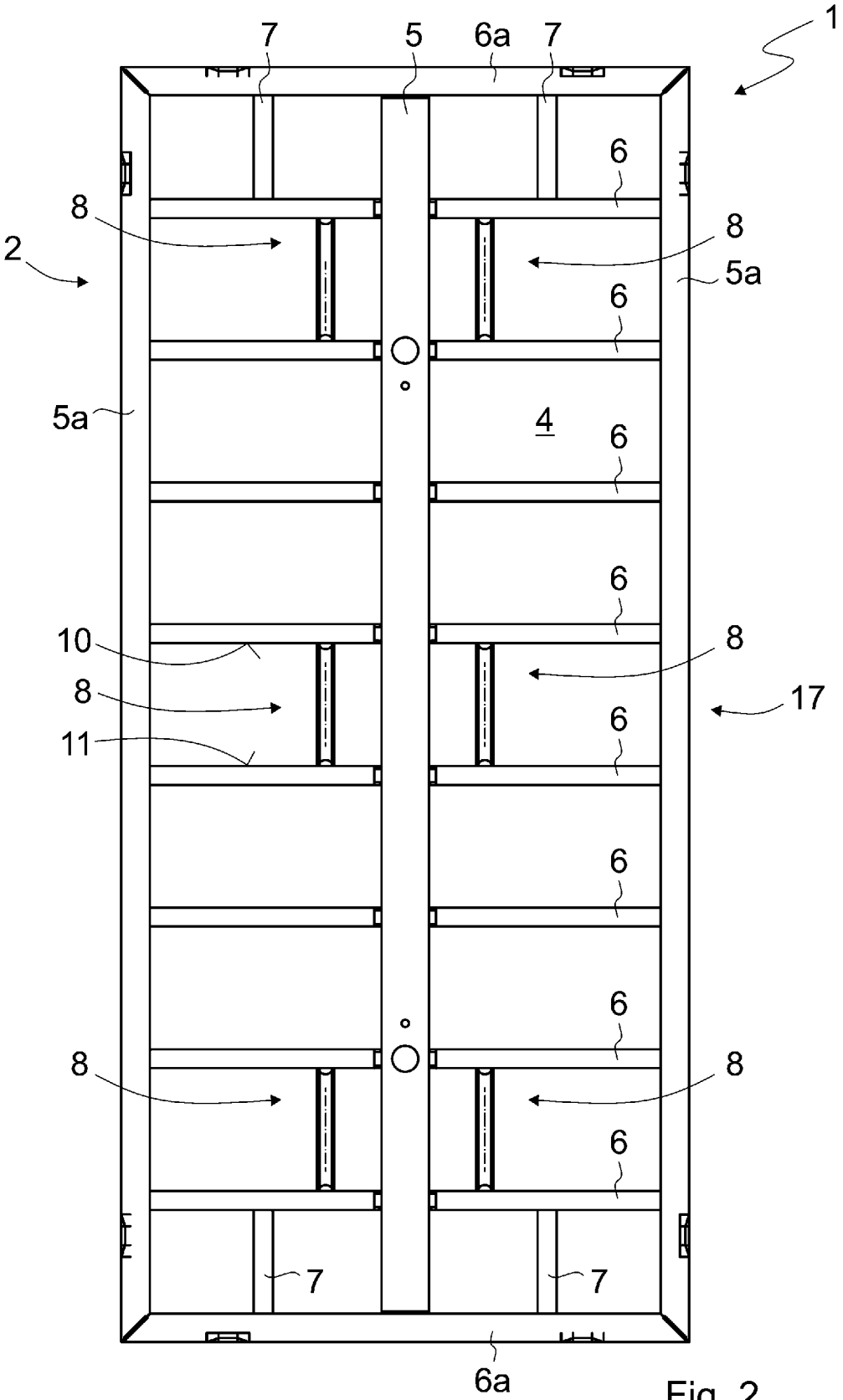
FIG. 2 a plan view of a rear side of the formwork panel according to the invention according to FIG. 1.
Figure 3:
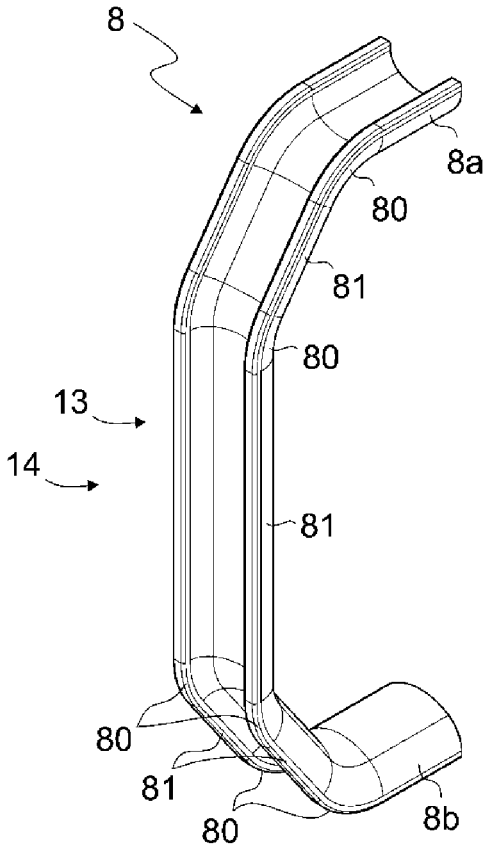
FIG. 3 a perspective view of a bridging element in a first embodiment.
Figure 4:
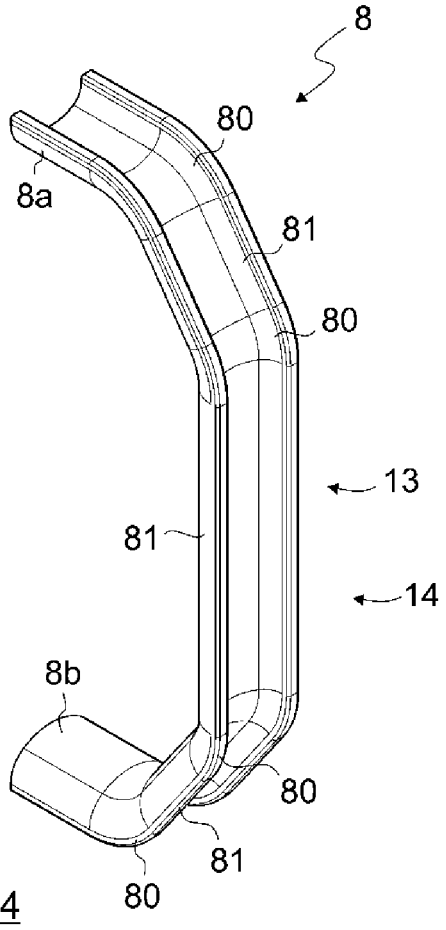
FIG. 4 a further perspective view of the bridging element according to FIG. 3.

FIGS. 1 and 2 show that the formwork panel 1 can have reinforcing webs 7 which run parallel to the longitudinal struts 5 and which are arranged between two transverse struts 6 and are fixed to the transverse struts 6. The reinforcing struts 7 are preferably arranged between the upper frame transverse strut 6*a* and the inner transverse strut 6 situated under it, and between the lower frame transverse strut 6*a* and the transverse strut 6 situated above it. The reinforcing struts 7 are optional and can also be omitted. Furthermore, the reinforcing struts 7 can also be positioned in some other way.

According to the invention, it is provided that at least one arc-shaped bridging element 8 is arranged between at least two transverse struts 6 that run adjacent to one another.

The bridging element 8 can preferably be designed as, or serve as, a handle or as a climbing aid or as a climbing strut and can be designed in such a way that a worker can ergonomically grasp it by hand.

The number of bridging elements 8 which are present in a formwork panel 1 can be arbitrary. In the exemplary embodiment according to FIGS. 1 to 7, six bridging elements 8 are provided. It is advantageous if at least two bridging elements 8 are provided, preferably at least four bridging elements 8. Furthermore, it can be advantageous if fewer than ten bridging elements 8 are realized in the formwork panel 1, in particular fewer than eight bridging elements 8.

It has proven to be particularly advantageous if at least two bridging elements 8, preferably exactly two bridging elements 8, are arranged between two adjacent transverse struts 6. This is shown correspondingly in FIGS. 1 and 2. In principle, a smaller or a larger number of bridging elements 8 can also be arranged between two adjacent transverse struts 6, but it has been found to be particularly suitable for handling the formwork panel 1 and with regard to the use of the bridging elements 8 if exactly two bridging elements 8 are arranged between two adjacent transverse struts 6.

Furthermore, it has been found to be advantageous if bridging elements 8 are inserted only between a part of the transverse struts 6.

In the exemplary embodiment according to FIGS. 1 to 7, it is provided that at least two transverse strut pairs, consisting of two transverse struts 6 running adjacent to one another, are provided, wherein in each case at least one bridging element 8, preferably at least two bridging elements 8, in particular exactly two bridging elements 8 (as shown), are arranged between the two transverse struts 6 of each transverse strut pair.

In the exemplary embodiment according to FIGS. 1 to 7, it is provided that three transverse strut pairs, consisting of in each case two transverse struts 6 running adjacent to one another, are provided with bridging elements 8; in the exemplary embodiment, with exactly two bridging elements 8 in each case.

In the exemplary embodiment according to FIGS. 1 to 7, it is provided that in each case at least one transverse strut 6 on which no bridging element 8 is fixed is arranged between two transverse strut pairs.

In the exemplary embodiment according to FIGS. 1 to 7, it is further provided that the bridging elements 8 are each arranged off-center between the inner longitudinal strut 5 and one of the outer frame longitudinal struts 5*a*, preferably such that the bridging elements 8 are arranged closer to the inner longitudinal strut 5 than to the respective outer frame longitudinal strut 5*a*. Preferably, the bridging elements 8 are arranged adjacent to the inner longitudinal strut 5.

It is advantageous, as shown in FIGS. 1 and 2, if the two bridging elements 8, which are arranged between two adjacent transverse struts, have an identical distance from the inner longitudinal strut 5, or the inner longitudinal strut 5 runs centrally between the two transverse struts.

According to the invention, it is provided that the bridging elements 8 each have two end regions 8*a*, 8*b* and one of the end regions 8*a*, 8*b* is respectively fixed to one of the two adjacent transverse struts 6.

The end regions 8*a*, 8*b* are shown in FIGS. 1 to 7. In the context of the invention, the region of the bridging element 8 which contacts the transverse strut 6 is in particular to be regarded as the end region 8*a*, 8*b*, in a way shown as an example in particular in FIGS. 5 to 7. The end regions 8*a*, 8*b* can be connected to the transverse struts 6 in a positive-fitting, nonpositive-fitting and/or materially bonded manner, preferably riveted, screwed, and/or welded. In the exemplary embodiment, it is provided in a manner not shown in more detail that the end regions 8*a*, 8*b* are welded to the transverse struts 6. For this purpose, weld seams can be placed on the contact regions 9 between the respective end region 8*a*, 8*b* and the transverse strut 6. Preferably, each end region 8*a*, 8*b* is welded to the transverse strut 6 by means of two weld seams at the contact regions 9. The weld seams are not shown in FIGS. 1 to 7.

In the exemplary embodiment, the transverse struts 6 each have a lower side 10 and an upper side 11, which extend substantially orthogonally to the front side 3 of the frame 2. The upper side 11 and the lower side 10 of the transverse struts also extend here orthogonally to the formwork shell 4. In the exemplary embodiment, it is provided that an upper end region 8*a* of the bridging element 8 is fixed, preferably welded, to the lower side 10 of an upper transverse strut 6 of the transverse strut pair and a lower end region 8*b* of the bridging element 8 is fixed, preferably welded, to the upper side 11 of a lower transverse strut 6 of the transverse strut pair.

Figure 5:
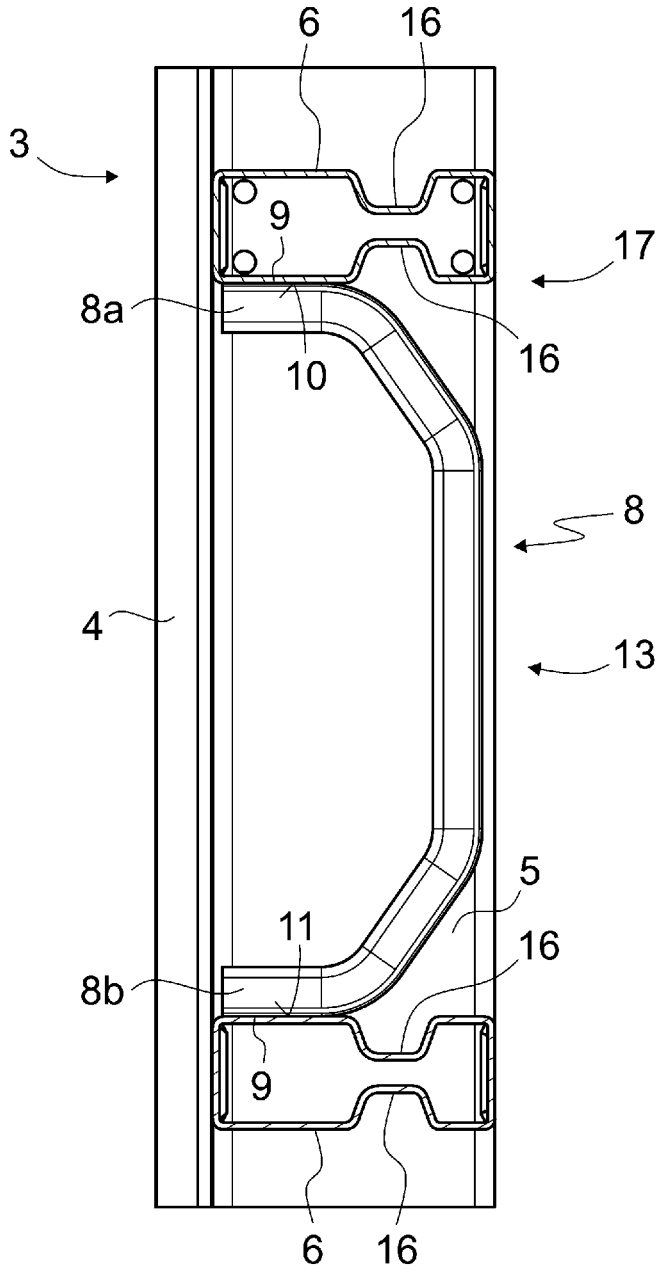
FIG. 5 a cross-section through a region of the formwork panel in which the bridging element shown in FIG. 3 is fixed between two adjacent transverse struts.
Figure 6:
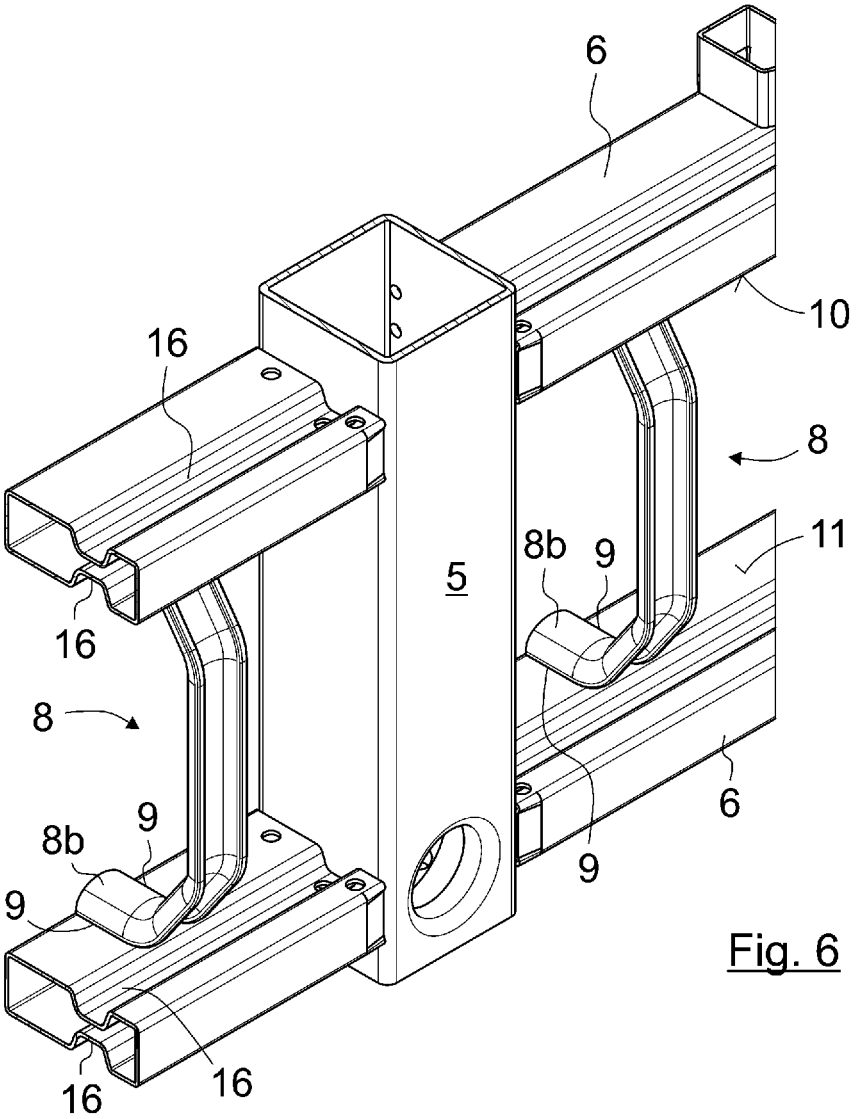
FIG. 6 a perspective view of a region of the formwork panel in which two bridging elements shown in FIG. 3 are fixed between two adjacent transverse struts.
Figure 7:
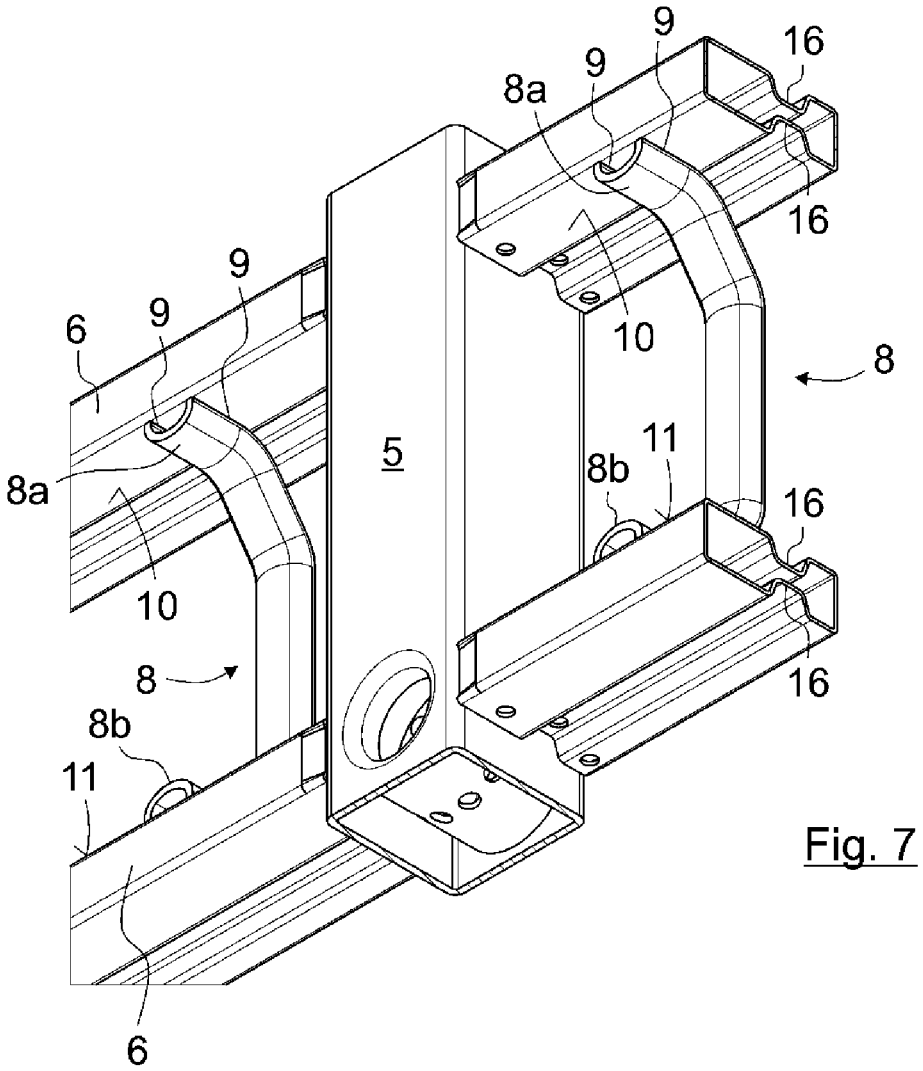
FIG. 7 a further perspective view of a region of the formwork panel according to FIG. 6.
Figure 8:
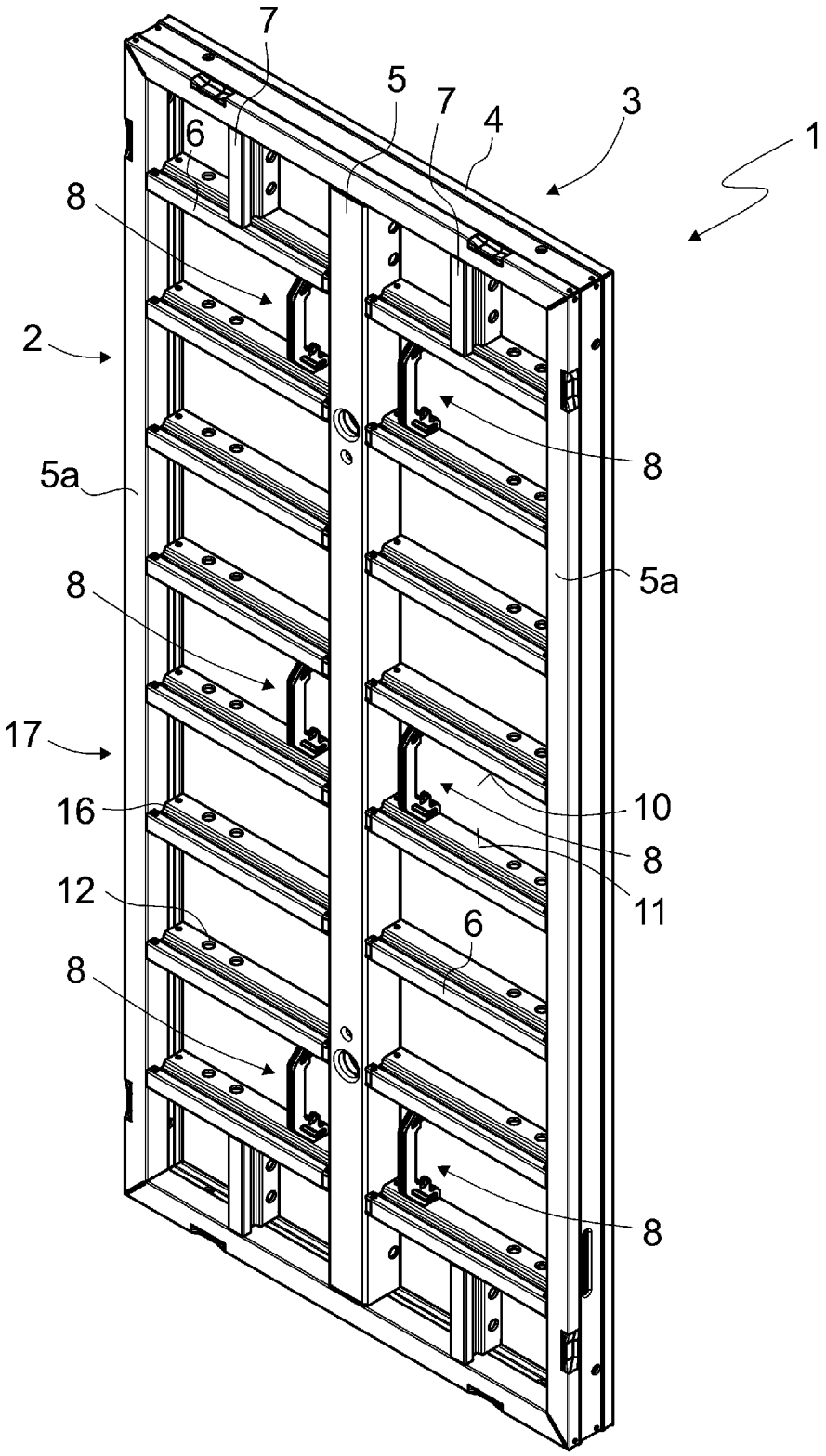
FIG. 8 a perspective view of a formwork panel according to the invention in a second embodiment.
Figure 9:
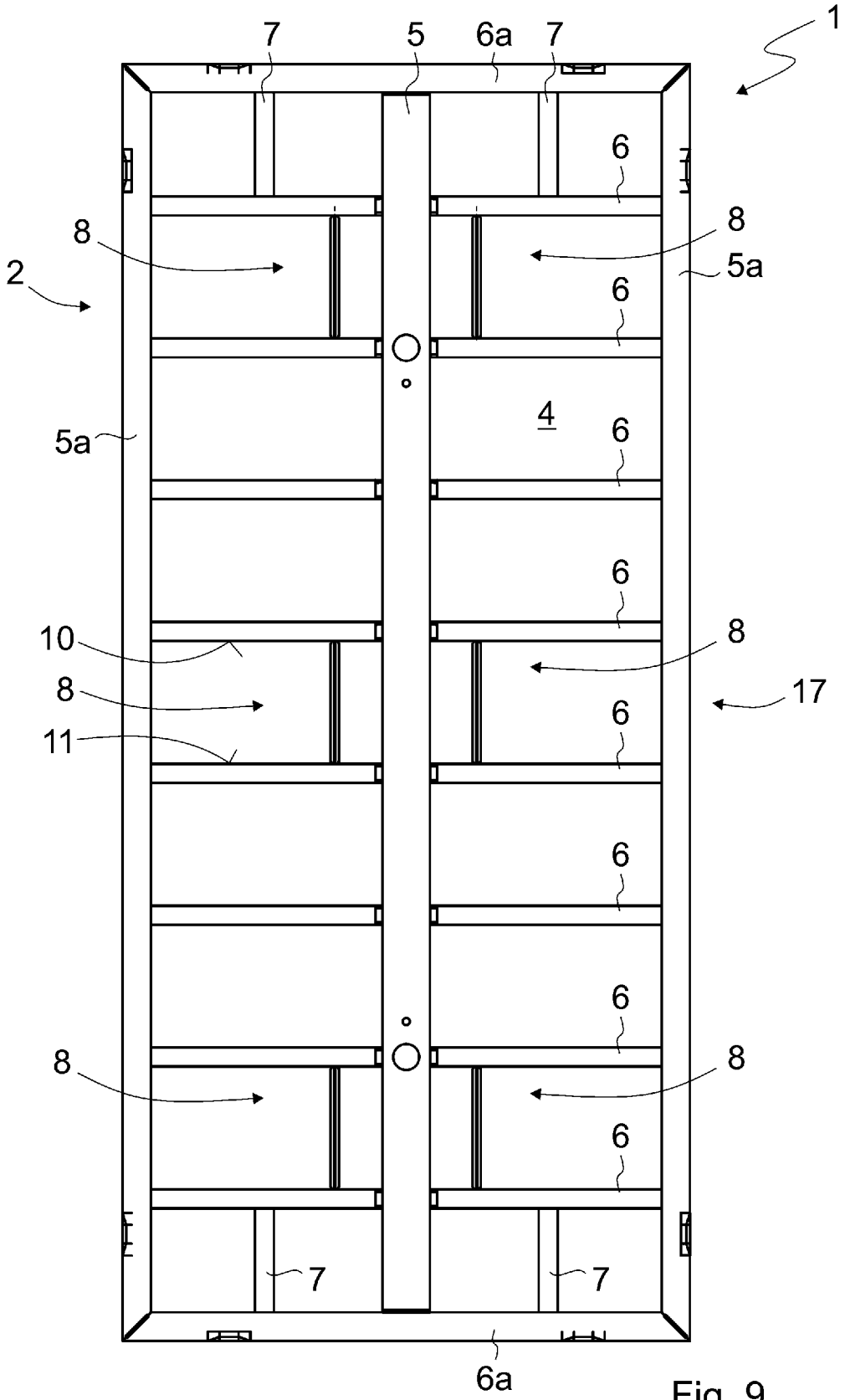
FIG. 9 a plan view of a rear side of the formwork panel according to the invention according to FIG. 8.
Figure 10:
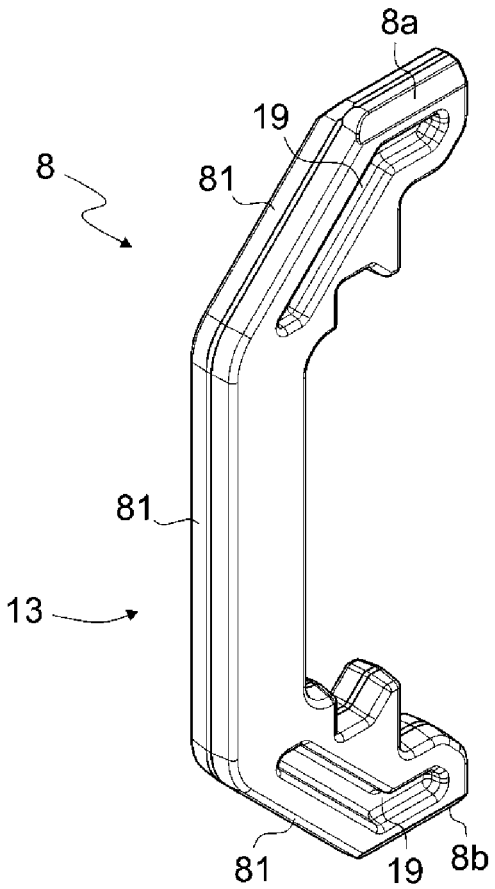
FIG. 10 a perspective view of a bridging element in a second embodiment.
Figure 11:
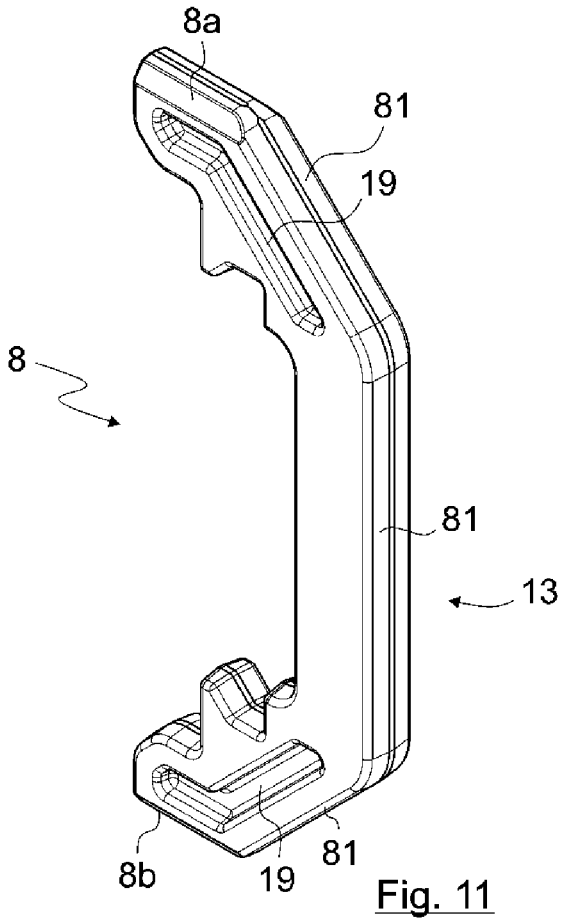
FIG. 11 a further perspective view of the bridging element according to FIG. 10.
Figure 12:
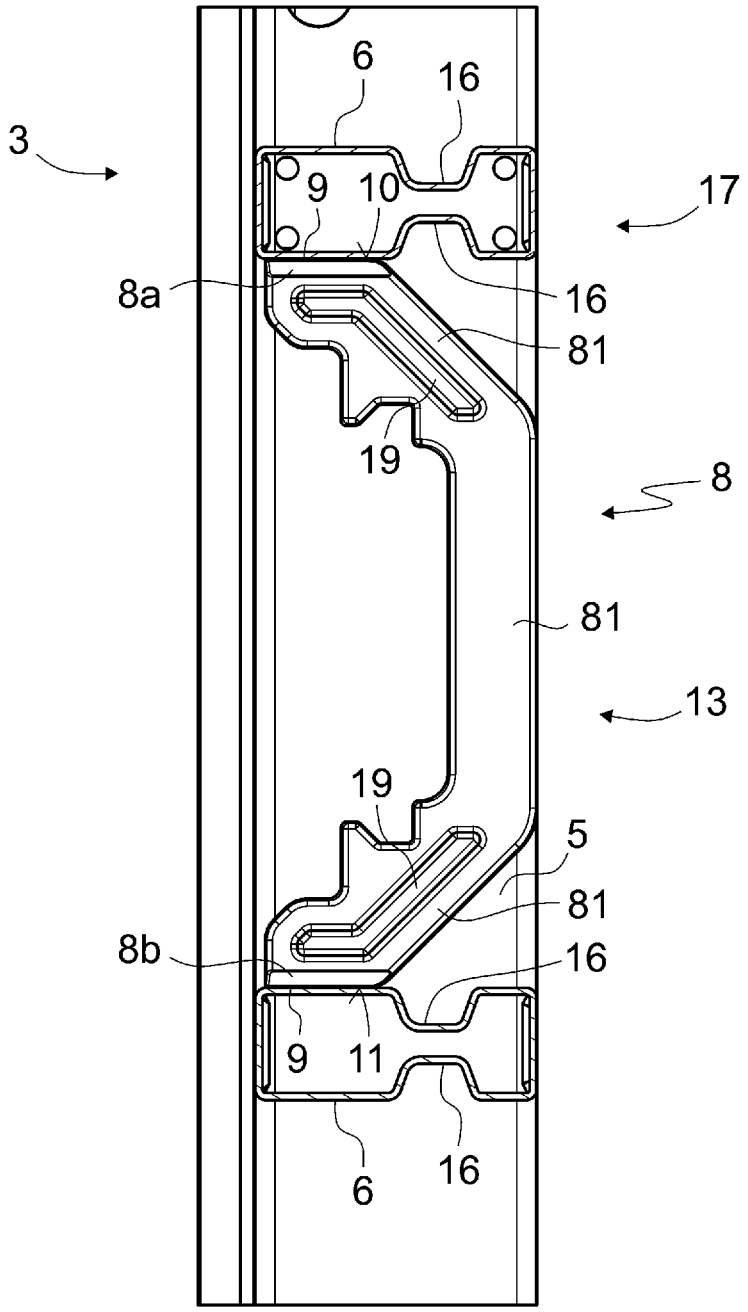
FIG. 12 a cross-section through a region of the formwork panel in which the bridging element shown in FIG. 10 is fixed between two adjacent transverse struts.
Figure 13:
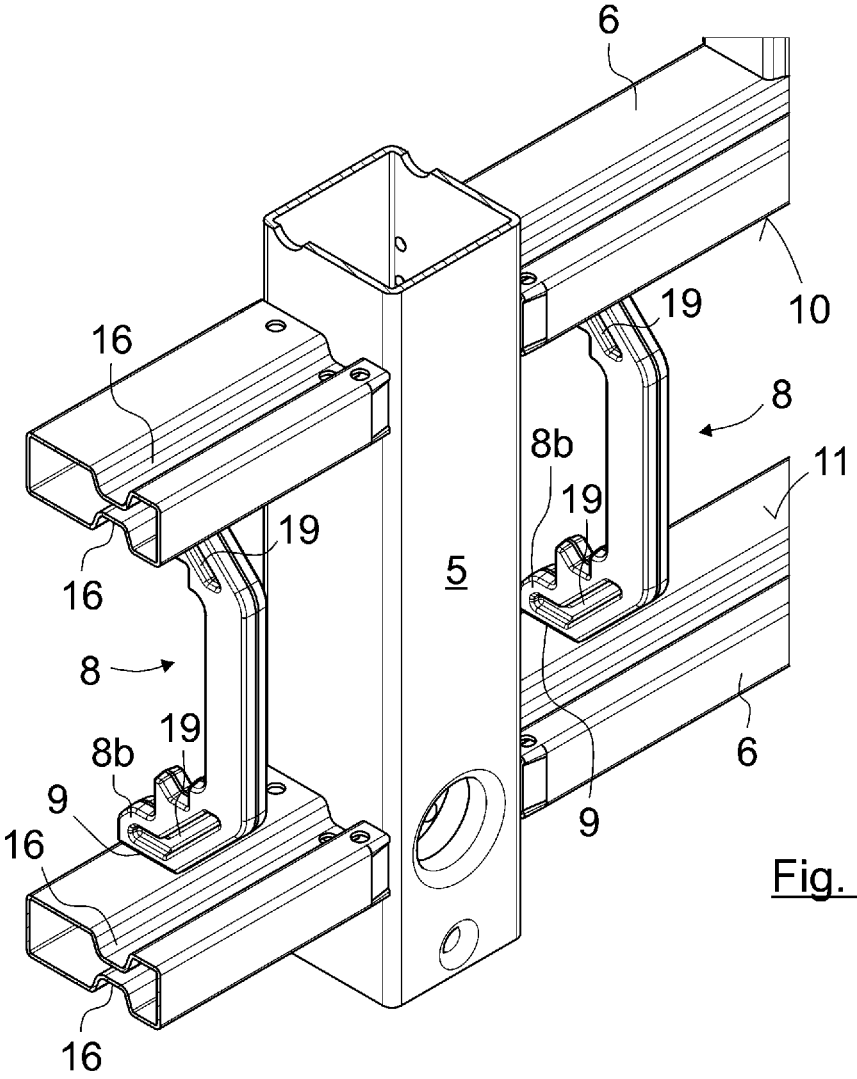
FIG. 13 a perspective view of a region of the formwork panel in which two bridging elements shown in FIG. 10 are fixed between two adjacent transverse struts.
Figure 14:
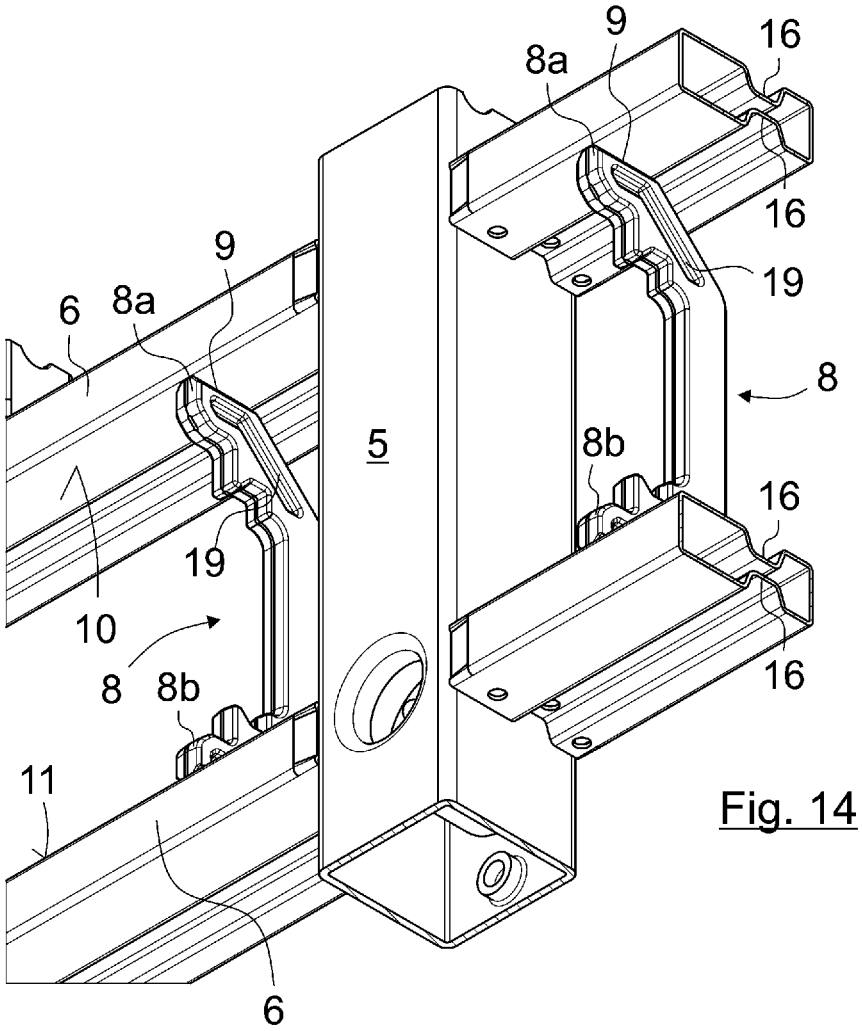
FIG. 14 a further perspective view of a region of the formwork panel according to FIG. 13.
Figure 15:
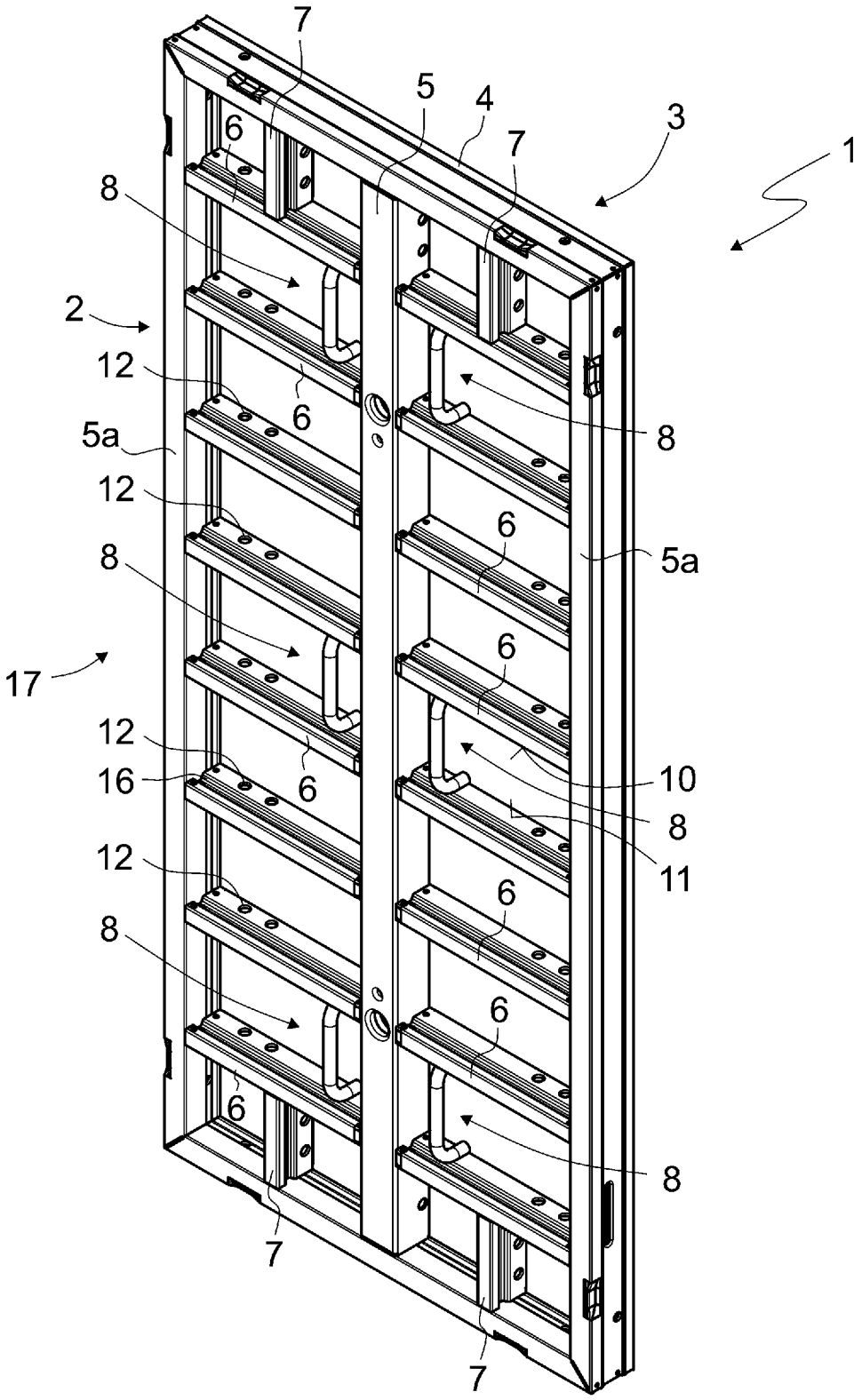
FIG. 15 a perspective view of a formwork panel according to the invention in third embodiment.
Figure 16:
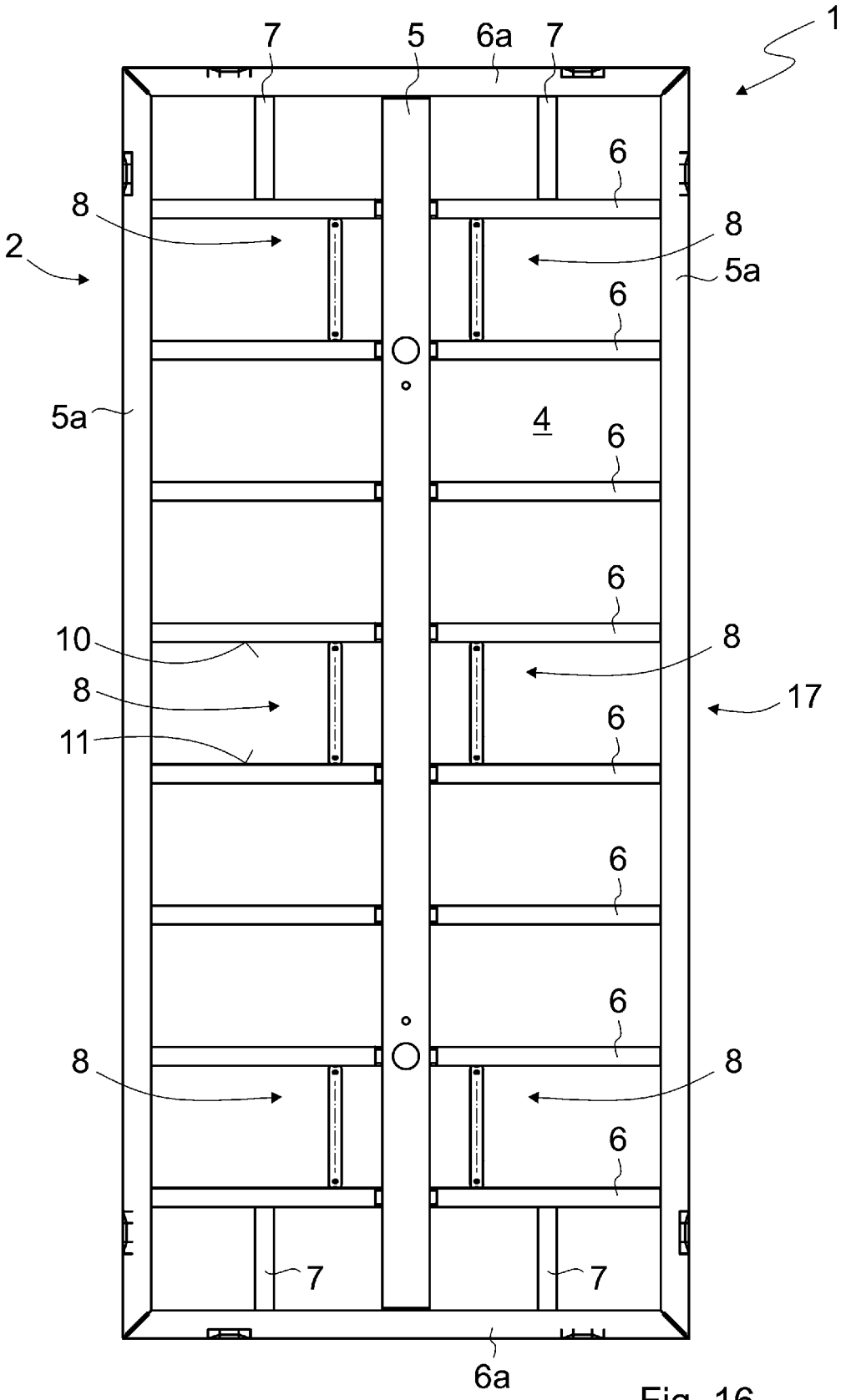
FIG. 16 a plan view of a rear side of the formwork panel according to the invention according to FIG. 15.
Figure 17:
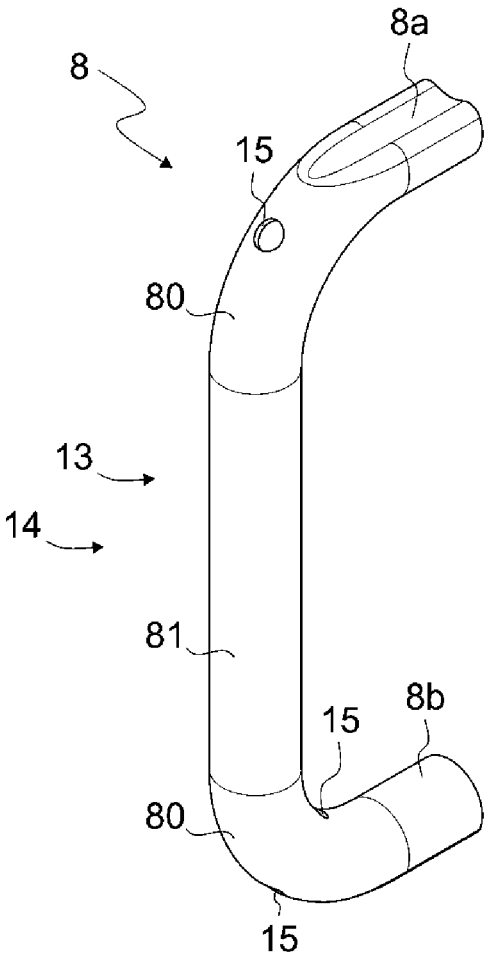
FIG. 17 a perspective view of a bridging element in a third embodiment.
Figure 18:
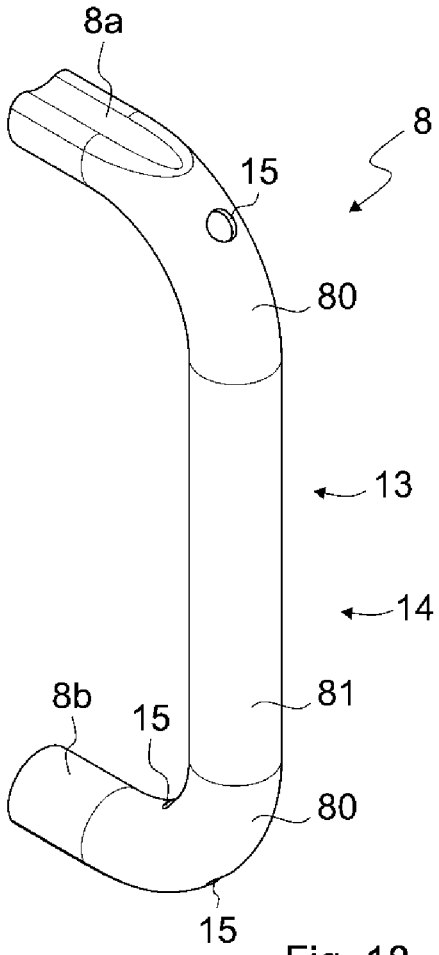
FIG. 18 a further perspective view of the bridging element according to FIG. 17.
Figure 19:
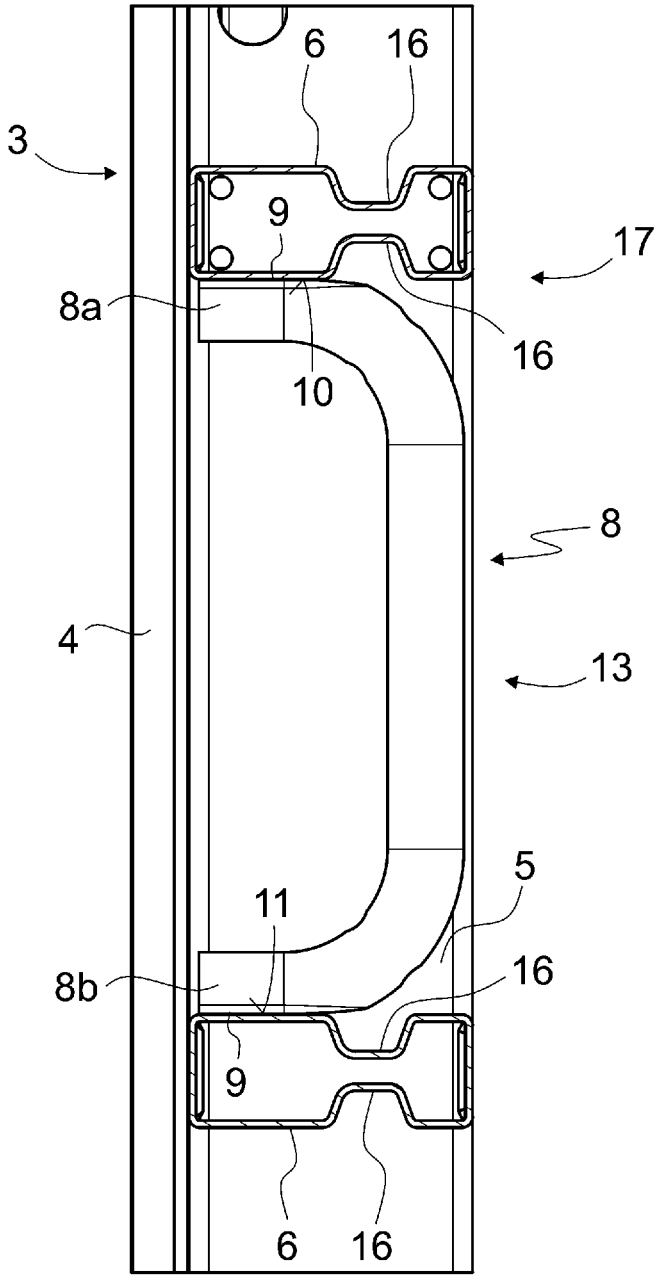
FIG. 19 a cross-section through a region of the formwork panel in which the bridging element shown in FIG. 17 is fixed between two adjacent transverse struts.
Figure 20:
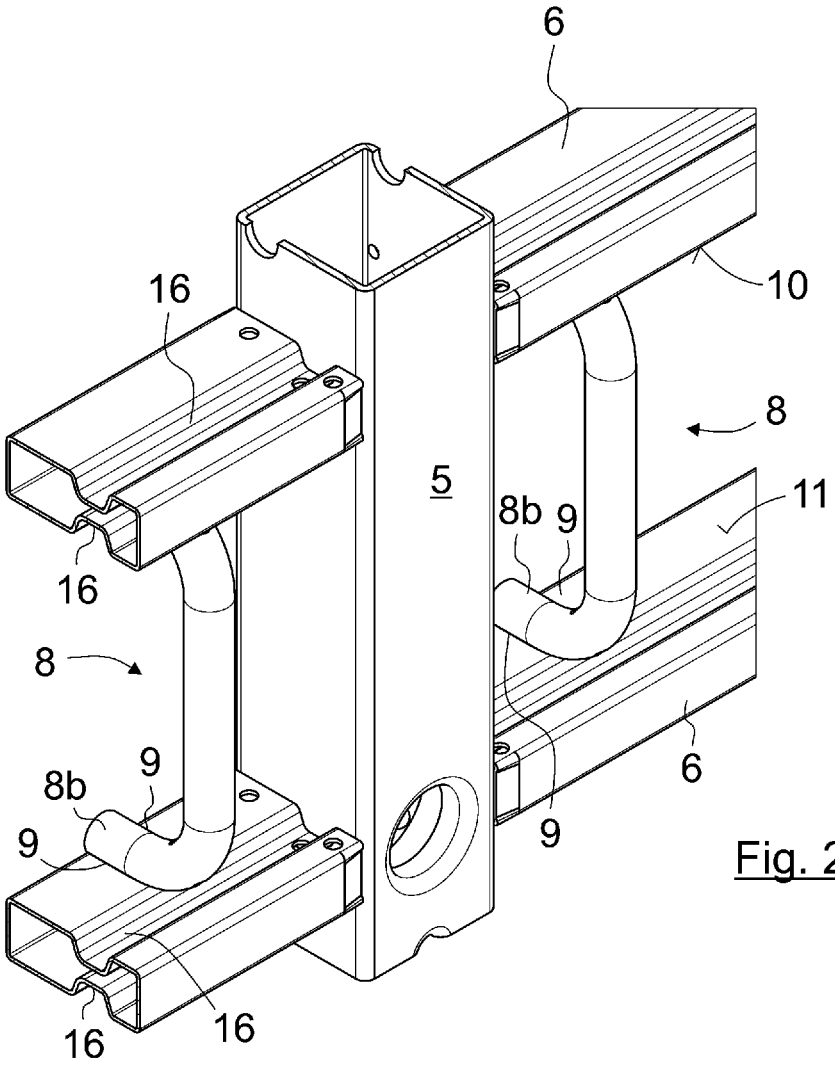
FIG. 20 a perspective view of a region of the formwork panel in which two bridging elements shown in FIG. 17 are fixed between two adjacent transverse struts.
Figure 21:
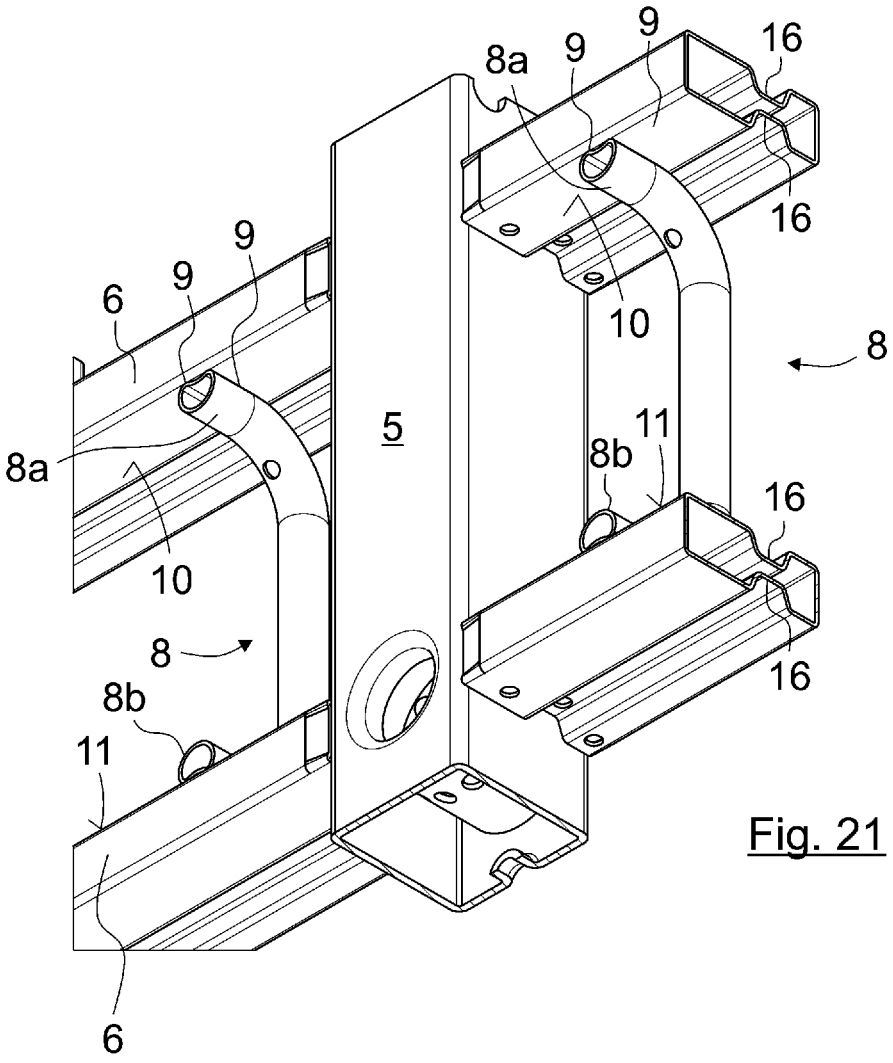
FIG. 21 a further perspective view of a region of the formwork panel according to FIG. 20.
Figure 22:
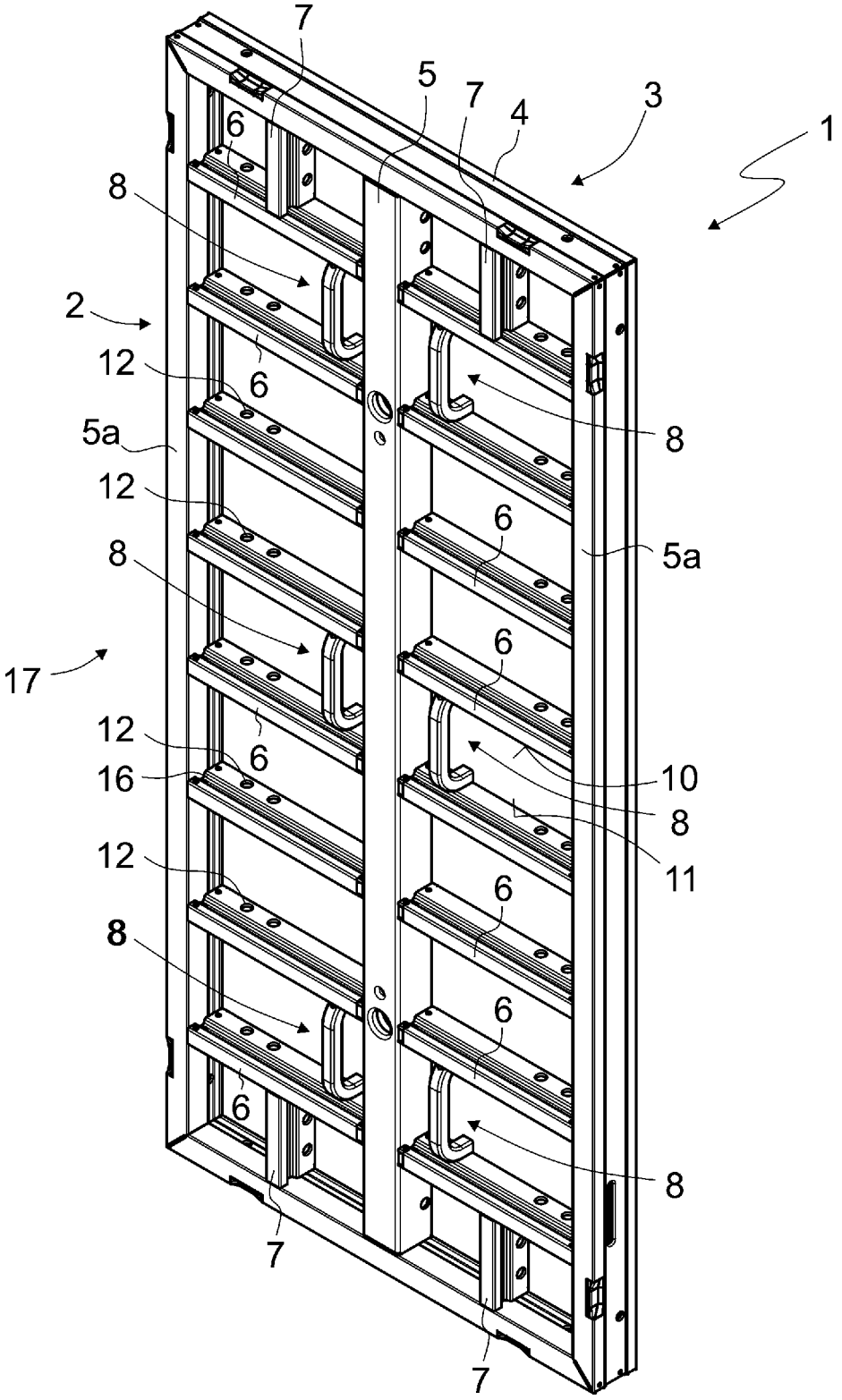
FIG. 22 a perspective view of a formwork panel according to the invention in a fourth embodiment.
Figure 23:
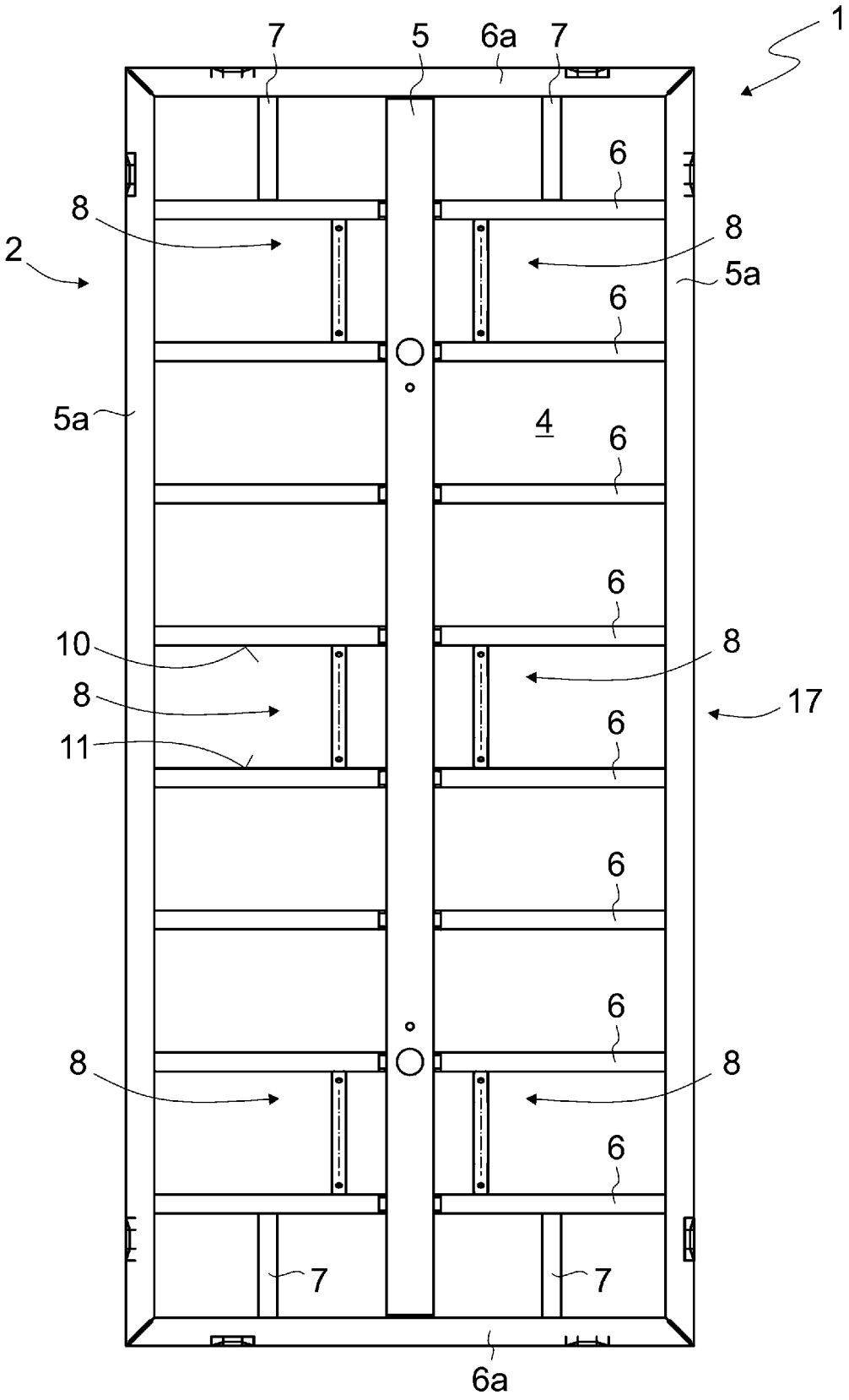
FIG. 23 a plan view of a rear side of the formwork panel according to the invention according to FIG. 22.
Figure 24:
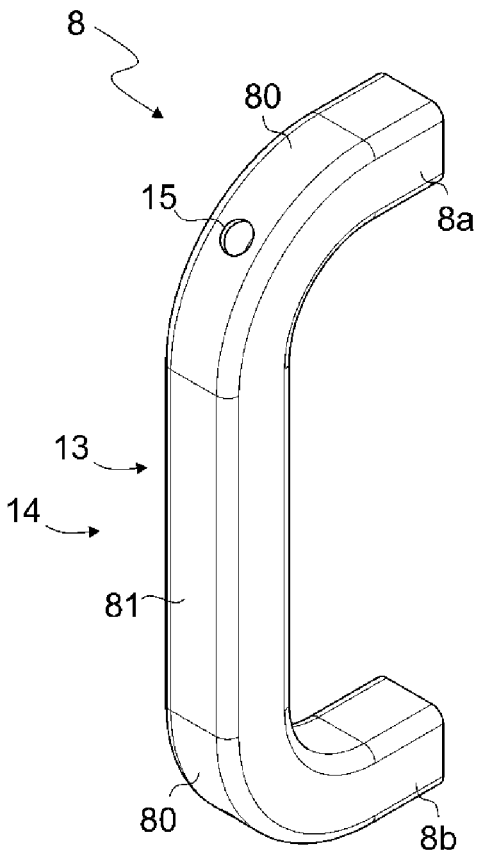
FIG. 24 a perspective view of a bridging element in a fourth embodiment.
Figure 25:
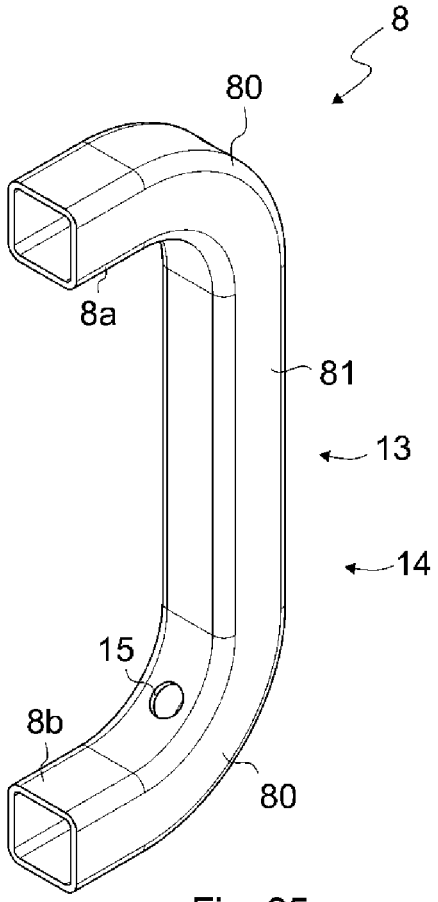
FIG. 25 a further perspective view of the bridging element according to FIG. 24.
Figure 26:
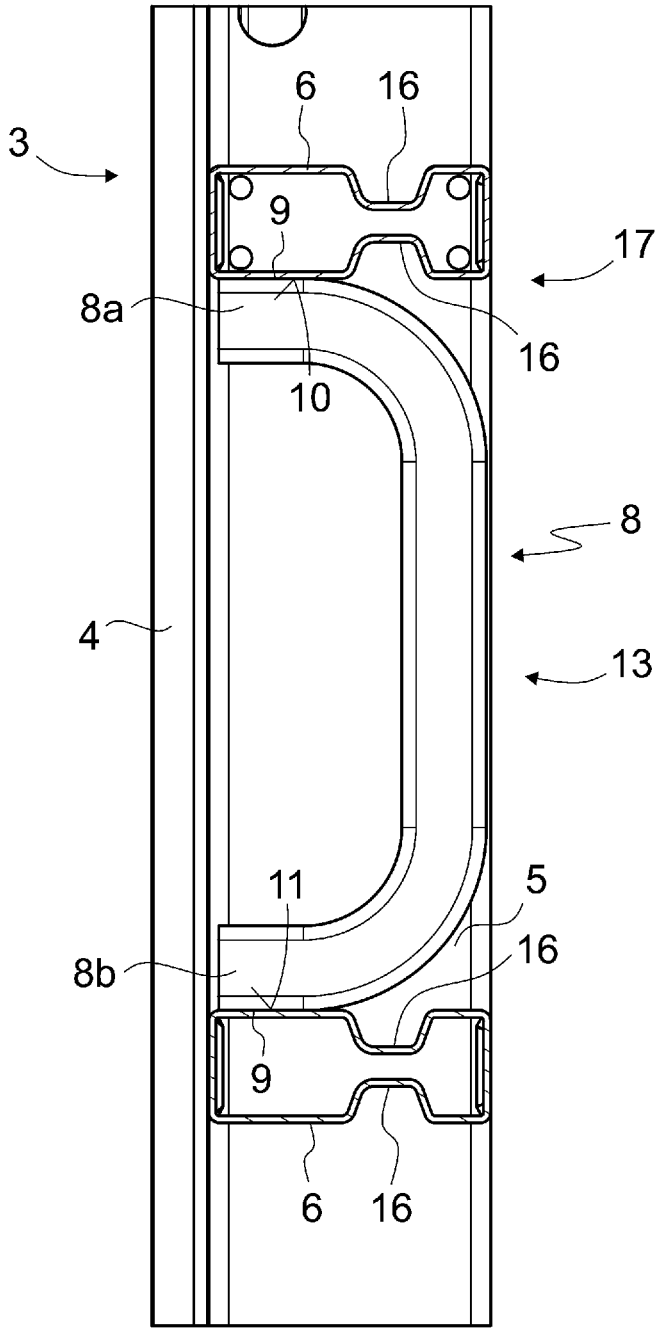
FIG. 26 a cross-section through a region of the formwork panel in which the bridging element shown in FIG. 24 is fixed between two adjacent transverse struts.
Figure 27:
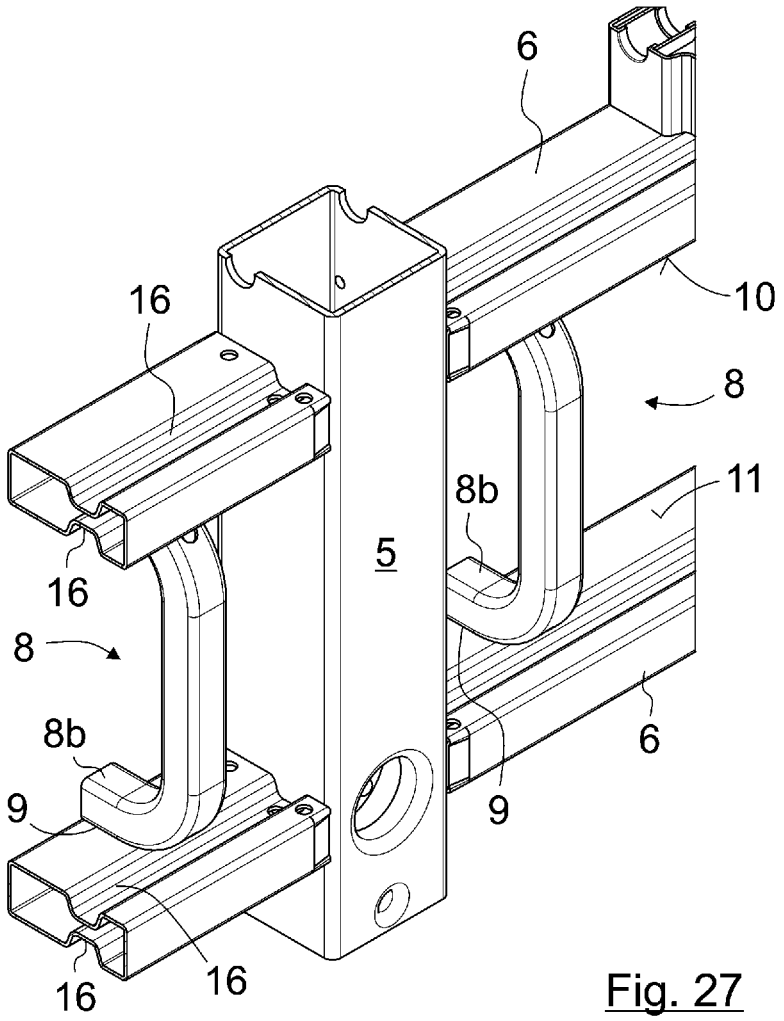
FIG. 27 a perspective view of a region of the formwork panel in which two bridging elements shown in FIG. 24 are fixed between two adjacent transverse struts.
Figure 28:
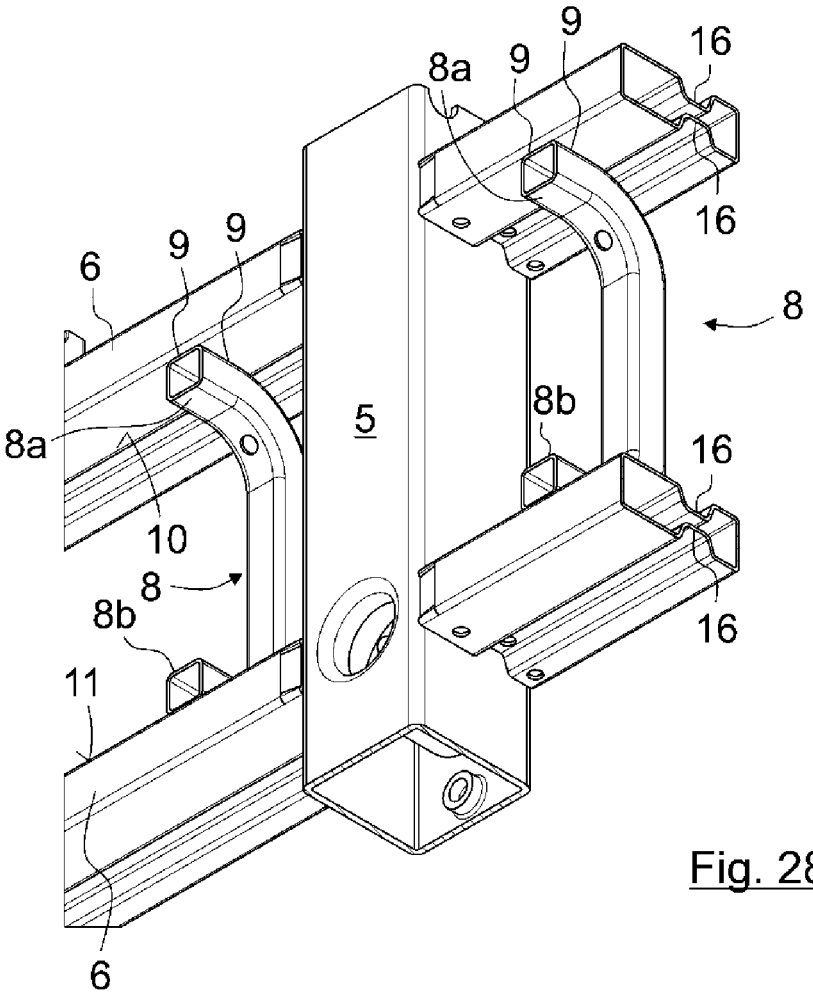
FIG. 28 a further perspective view of a region of the formwork panel according to FIG. 27.

As can be seen in particular from FIGS. 5 to 7, the end regions 8*a*, 8*b* of the bridging element 8 are preferably designed such that the end regions 8*a*, 8*b* extend substantially orthogonally to the front side 3 of the frame 2, or the formwork shell 4, adjacent to the respective upper side 11 or the respective lower side 10 of the transverse strut 6. As a result, contact regions 9 can be formed in a simple manner between the end regions 8*a*, 8*b* and the lower side 10 or the upper side 11 of the transverse strut 6, which enable a simple fixing, in particular welding.

As can be seen from FIG. 1, the transverse struts 6, preferably all the inner transverse struts 6, can have holes 12 for liquid drainage.

The bridging element 8 is preferably made symmetrically starting from the end regions 8*a*, 8*b*.

As can be seen from FIGS. 1 to 7, the bridging elements 8 are designed and fixed to the transverse struts 6 in such a way that a handling region 13 of the respective bridging element 8 formed between the end regions 8*a*, 8*b* has a greater distance from the front side 3 of the frame 2 than the two end regions 8*a*, 8*b* of the bridging element 8 fixed to the transverse struts 6.

If the bridging element 8 is designed as a handle, the handling region can also be referred to as, or serve as, a gripping region for the hand of a worker.

In the exemplary embodiment according to FIGS. 1 to 7, the arc-shaped design of the bridging element 8 results due to the fact that the bridging element 8 between the end regions 8*a*, 8*b* has, at least in sections, a curved and/or arc-shaped profile and/or a profile that is inclined relative to the longitudinal struts 5.

In particular, it can be provided that the arc-shaped design of the bridging element 8 results from the fact that a central region 14, comprising the handling region 13, of the bridging element 8, which central region extends between the two end regions 8*a*, 8*b* fixed to the transverse struts 6, is arc-shaped.

In the exemplary embodiment, it is provided that the central region 14 comprises the entire region of the bridging element 8 that extends between the end regions 8*a*, 8*b*. The handling region 13 is here a partial region of the central region 14. The handling region 13 is preferably designed such that the ends of the handling region 13 have an identical distance to the respectively facing end region 8*a*, 8*b*, i.e., the handling region 13 is arranged centrally in the central region 14.

In the exemplary embodiment according to FIGS. 1 to 7, it can be provided that at least one central section of the handling region 13 runs parallel to the longitudinal struts 5. In the exemplary embodiment, it is preferably provided that the entire handling region 13 is designed such that it runs parallel to the longitudinal struts 5. As a result, the handling region 13 can be gripped particularly ergonomically and securely by one hand of a worker, which is advantageous in particular when the bridging element 8 is designed as a handle or as a climbing aid.

It is advantageous if the entire handling region 13 extends parallel to the longitudinal struts 5. However, it may be sufficient if at least one central section of the handling region 13 runs parallel to the longitudinal struts in order to enable an ergonomic gripping or also to enable the affixing of protective equipment in a simple manner.

In the exemplary embodiment according to FIGS. 1 to 7, the bridging element 8 can be designed as a tube, preferably with a respective moisture outlet opening 15 in a section delimiting the end region 8*a*, 8*b*. Alternatively, the bridging element 8 can also be designed as a longitudinally cut tube and/or as a bent flat material. The bridging element 8 can also be designed as a rod, in particular made of a solid material.

The bridging element 8 is preferably made of metal, in particular steel or aluminum.

In the exemplary embodiment according to FIGS. 1 to 7, the bridging element 8 is designed as a bent flat material which is preferably bent or folded at least twice along the longitudinal edges.

Furthermore, in the exemplary embodiment according to FIGS. 1 to 7, it is provided that the bridging element 8 between the end regions 8*a*, 8*b*, i.e., in the middle region 14, is designed in such a way that the upper end region 8*a* and the lower end region 8*b* are initially adjoined by a curved or bent section 80. The bent section 80 is then followed by a straight section 81. The straight section 81 is then in turn joined by a bent section 80, between which a straight section 81 is formed, which forms the handling area 13 and which runs parallel to the longitudinal struts 5.

In principle, a different number of bent and straight sections 80, 81 and another configuration are also possible. However, the formation of the bridging element 8 with bent sections 80 and straight sections 81 shown in the exemplary embodiment in FIGS. 1 to 7 has proven to be particularly suitable.

In the exemplary embodiment according to FIGS. 1 to 7, it is further provided that at least a part of the transverse struts 6 in the upper side 11 and the lower side 10 each has at least one groove 16 which runs in the longitudinal direction of the transverse struts 6.

In the exemplary embodiment according to FIGS. 1 to 7, it is provided that all inner transverse struts 6 have such grooves 16. However, it can also be provided that only a part of the transverse struts 6 has such grooves 16.

In the exemplary embodiment according to FIGS. 1 to 7, it is provided that all inner transverse struts 6 have grooves 16, but the outer frame transverse struts 6*a* do not have grooves.

In the cross-section of the respective transverse strut 6, the grooves 16 are arranged axially symmetrically to one another. Furthermore, the grooves 16 are arranged opposite one another. Viewed in the cross-section of the respective transverse strut 6, the grooves 16 have at least approximately the same shape. This can be seen particularly well in FIGS. 5 to 7.

It can be provided that the grooves 16 extend at least over a partial length of the respective transverse strut 6. In the exemplary embodiment, it is provided that the grooves 16 extend over the entire length of the respective transverse strut 6.

The grooves 16 run at a uniform distance from the front side 3 of the frame 2 in the respective transverse struts 6.

The holes 12 are preferably located in the section of the lower side or the upper side of the transverse strut 6 in which the grooves 16 are not formed.

In the exemplary embodiment according to FIGS. 1 to 7, it is provided that the grooves 16 run off-center in the upper sides 11 and the lower sides 10 of the respective transverse strut 6, in such a way that the grooves 16 run closer to a rear side 17 of the frame 2 than to the front side 3. This can be seen particularly well in FIGS. 1, 5, 6 and 7.

The grooves 16 and their preferably provided arrangement, in particular such that the grooves 16 run closer to the rear side 17 of the frame 2 than to the front side 3, makes it possible to fix a connecting component 18, in particular a clamping device, on the transverse strut 6, in particular in the grooves 16 of a transverse strut 6, in a way illustrated in principle in FIG. 29, which will be discussed in more detail below.

As can be seen from the exemplary embodiment according to FIGS. 1 to 7, the end regions 8*a*, 8*b* of the bridging element 8 are fixed to sections of the upper side 11 and the lower side 10 which are located between the grooves 16 and the front side 3 of the frame 2, the ends, i.e., the front free ends of the end regions 8*a*, 8*b* of the bridging element 8, preferably lying in a plane with the front side 3 of the frame 2. This can be seen particularly well in FIGS. 5 to 7.

The bridging elements 8 according to the invention can be used particularly advantageously in combination with the grooves 16 in the transverse struts 6.

It has been shown that forming grooves 16 off-center in such a way that they run closer to the rear side 17 of the frame is particularly suitable for attaching a connecting component 18 in the grooves 16. However, the surface of the lower side 10 or of the upper side 11 of the transverse strut 6 in which the grooves 16 are arranged is then not available for the fixing of the bridging element 8 there. However, without the arc-shaped course of the bridging element 8 provided according to the invention, a fixing in the remaining section of the upper side 11 or the lower side 10 of the transverse strut 6 would have the result that a hand of a worker cannot, or can no longer advantageously, grip around the bridging element 8. This problem is solved in an advantageous manner by the arc-shaped course of the transmission element 8. Furthermore, it has been shown that the arc-shaped profile, in particular the resulting design of the end regions 8*a*, 8*b* of the bridging element 8, makes it possible to achieve particularly good fixing on the lower side 10 or the upper side 11 of a transverse strut 6, in particular when welding is provided with the aid of two weld seams in each case.

FIGS. 8 to 14 show a second exemplary embodiment of the formwork panel 1 according to the invention, which differs from the first exemplary embodiment in that the bridging elements 8 have a different arc-shaped design or are designed in a different manner.

It should be noted that all the embodiments, options, and also the preferably provided features which have been described with respect to the first exemplary embodiment according to FIGS. 1 to 7 can also be implemented in the second exemplary embodiment, and also in the third and fourth exemplary embodiments presented below. In order to avoid repetition, no additional reference is made to this, but only the differing design is presented.

The bridging element 8 according to the second exemplary embodiment is characterized in that the end regions 8*a*, 8*b* are initially adjoined by a straight section 81 which runs upward at an angle of 10 to 60°, preferably 20 to 50°, starting from the lower side 10 or the upper side 11 of the transverse strut 6. Located between the two straight sections 81 here is the handling area 13, which is essentially formed by a straight section 81 which runs parallel to the longitudinal struts 5. The straight section 81 forming the handling area 13 has a transition radius at its two ends, with which the handling area 13 of the bridging element 8 is connected to the two adjacent straight sections 81.

Preferably, the bridging element 8 is formed integrally (including the end sections 8*a*, 8*b*) along its course from the lower end section 8*b* to the upper end section 8*a*. This preferably applies to all exemplary embodiments.

The bridging element 8 according to the second exemplary embodiment can be a solid component or a component which is composed of two half shells.

As shown in the exemplary embodiment according to FIGS. 8 to 14, the bridging element 8 can have openings 19. As in the first exemplary embodiment, the end regions 8*a*, 8*b* are preferably designed such that they extend substantially orthogonally to the front side 3 of the frame 2, so that advantageous contact regions for connecting the end regions 8*a*, 8*b* to the lower side or the upper side 11 of the transverse strut 6 are provided.

The third exemplary embodiment according to FIGS. 15 to 21 has a bridging element 8 which is preferably designed as a tube, in particular with a substantially circular cross-section. The bridging element 8 in each case has two moisture openings 15 in a section adjacent to the end region 8*a*, 8*b*, in particular so that rainwater can flow out of the interior of the bridging element 8. The bridging element 8 then has, on the end regions 8*a*, 8*b*, first of all a bent section 80, between which the handling region 13 is located, which is preferably a straight section 81 which runs parallel to the longitudinal struts 5. The end regions 8*a*, 8*b* are designed such that they extend substantially orthogonally to the front side 3 of the frame 2. This is preferably achieved in that the tube which forms the bridging element 8 is cut off in the end regions 8*a*, 8*b* and preferably also a part along the adjoining bent section 81, so that a surface running substantially flat and orthogonally to the front side 3 of the frame 2 is formed, with the aid of which an advantageous contact region 9 with the lower side 10 and the upper side 11 of the transverse strut 6 can be formed, in such a way as can be seen from a combined view of FIGS. 17 to 21.

The fourth embodiment of the bridging element 8 according to FIGS. 22 to 28 corresponds substantially to the third embodiment, wherein the tube used there is a tube which has a rectangular cross-section, in particular a square cross-section. The transitions between the four sides of the tube can be beveled or rounded, so that no sharp edges are formed, which improves ergonomic handling. With regard to the further embodiments, reference is made accordingly to the third exemplary embodiment according to FIGS. 15 to 21.

Figure 29:
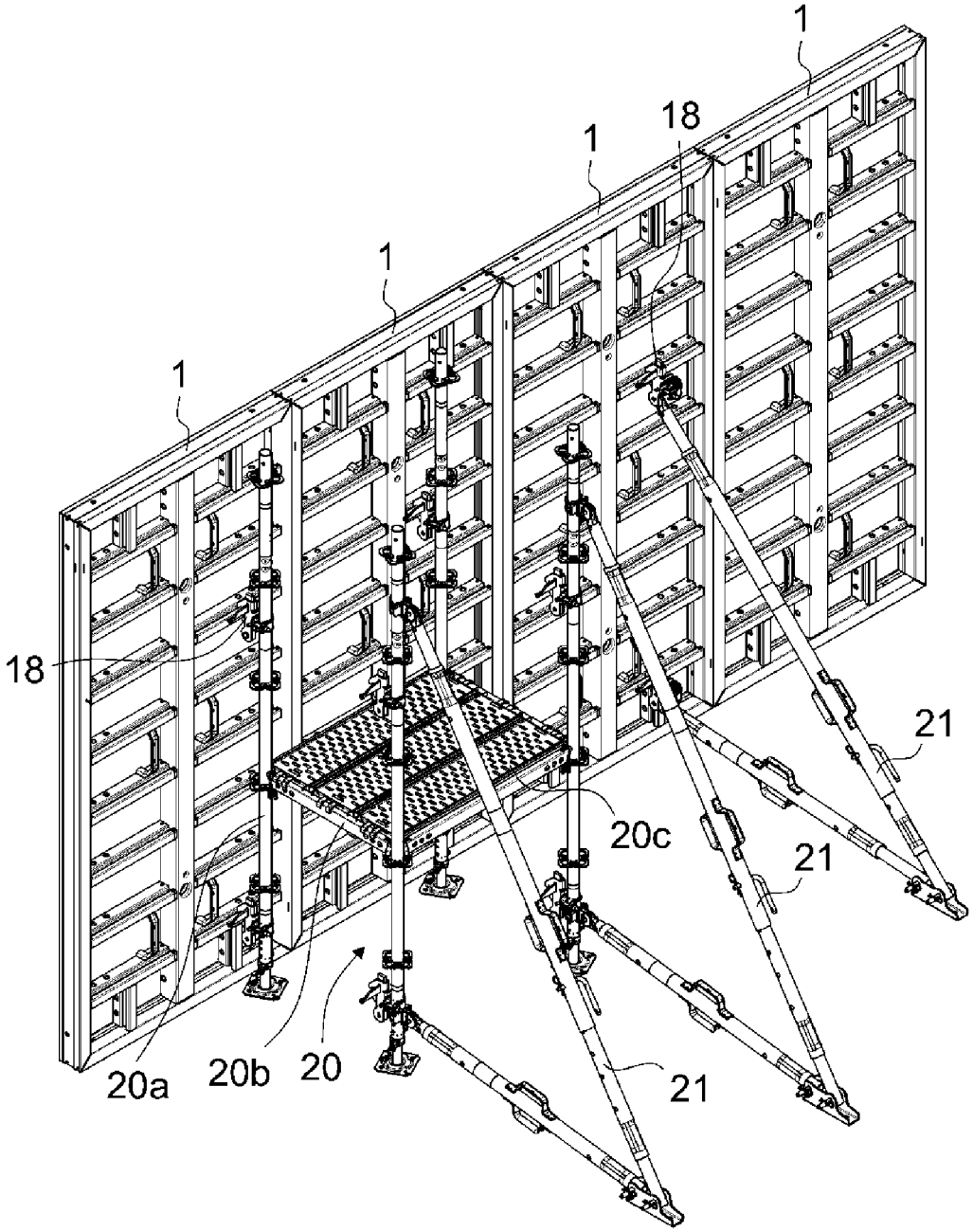
FIG. 29 a perspective view of a system for formwork of a wall element, comprising a plurality of formwork panels.

FIG. 29 shows a perspective view of a system for formwork of a wall element. In the exemplary embodiment, the system is composed of three formwork panels 1, wherein, for the formation of a receiving space for, for example, a concrete, a corresponding system is also to be positioned opposite, for example as described in WO 2021/148232 A1.

FIG. 29 is merely intended to illustrate that the grooves 16 can be used to attach connecting components 18 to the transverse struts 6. The connecting components 18 can serve to define a scaffold section 20 with vertical posts 20*a*, a horizontal bar 20*b* and a tread surface 20*c* as well as push-pull props 21. For this purpose, the connecting component 18 can have an interface for fixing on the formwork panel, in particular for fixing into the grooves 16, in a manner not designated in greater detail, and an add-on part interface on which the scaffold section 20, in particular the vertical posts 20*a*, are fixed, for example with the aid of clamps. Furthermore, the connecting component 18 can alternatively or additionally also have an add-on part interface on which the push-pull props 21 can be fixed, for which purpose the add-on part interface can be designed, for example, as a bore.

In the grooves 16, the connecting component 18 can be fixed continuously along the extension of the grooves 16.

The grooves 16 and the connecting components 18 make it possible to connect a scaffold or a scaffold section 20 directly to the formwork panel 1.

LIST OF REFERENCE SIGNS

1 Formwork panel
2 Frame
3 Front side
4 Formwork shell
5 Longitudinal strut
5*a* Frame longitudinal strut
6 Transverse strut
6*a* Frame transverse strut
7 Reinforcing web
8 Bridging element
8*a* Upper end region
8*b* Lower end region
9 Contact region
10 Lower side
11 Upper side
12 Holes
13 Handling area
14 Central region
15 Moisture outlet opening
16 Groove
17 Rear side
18 Connecting component
19 Breakthroughs
20 Scaffold section
20*a* Vertical posts
20*b* Horizontal bar
20*c* Tread surface
21 Push-pull props
80 Bent section
81 Straight section

The invention claimed is:

1. A formwork panel, comprising a frame on the front side of which a formwork shell can be fixed, wherein the frame has a plurality of longitudinal struts and a plurality of transverse struts running plane-parallel to one another, wherein the longitudinal struts and the transverse struts are arranged substantially perpendicular to one another, and wherein at least one bridging element is arranged between at least two transverse struts running adjacent to one another, wherein the bridging element has two end regions and one of the end regions is in each case fixed to one of the two adjacent transverse struts, wherein, the bridging element is fixed to two of the plurality of transverse struts such that a handling region of the bridging element formed between the two end regions has a greater distance from the front side of the frame than the two end regions of the bridging element that are fixed to the transverse struts, wherein, the end regions are connected to the transverse struts in one of a positive-fitting or materially bonded manner, wherein a shape of the bridging element is one of: i) a tube, wherein each tube-shaped bridging element includes at least one moisture outlet opening in a section adjoining the end region, ii) a longitudinally cut tube, iii) or a bent flat material.

2. The formwork panel according to claim 1, wherein the bridging element has a profile that is at least one of:

curved;

arc-shaped; or inclined relative to the longitudinal struts between the end regions at least in sections.

3. The formwork panel according to claim 1, wherein a central region of the bridging element is arc-shaped, the central region comprising a handling region of the bridging element, which central region extends between the two end regions fixed on the transverse struts.

4. The formwork panel according to claim 3,
wherein, at least a central section of the handling region runs parallel to the longitudinal struts.

5. The formwork panel according to claim 1,
wherein the end regions of the bridging element are symmetric.

6. The formwork panel according to claim 1,
wherein, the plurality of transverse struts includes two outer frame transverse struts and the plurality of longitudinal struts includes two outer frame longitudinal struts between which at least two inner transverse struts of the plurality of transverse struts are arranged, the bridging element being arranged between two of the inner transverse struts.

7. The formwork panel according to claim 6,
wherein, the upper side and the lower side of all inner transverse struts includes grooves in the longitudinal direction of the transverse struts and the outer frame transverse struts do not have grooves.

8. The formwork panel according to claim 1,
wherein exactly two bridging elements are arranged between the two transverse struts.

9. The formwork panel according to claim 1,
wherein three transverse strut pairs are provided, each consisting of two transverse struts running adjacent to one another, wherein exactly two bridging elements are arranged between the two transverse struts of each transverse strut pair.

10. The formwork panel according to claim 9,
wherein at least one transverse strut of the plurality of transverse struts has no bridging element fixed thereon and is arranged between two transverse strut pairs.

11. The formwork panel according to claim 1, wherein the end regions are one of: riveted, screwed, or welded to the transverse struts.

12. The formwork panel according to claim 1, wherein the end regions are welded to the transverse struts and the shape of the bridging element is one of: the longitudinally cut tube or the bent flat material.

13. A formwork panel, comprising:
a frame on the front side of which a formwork shell can be fixed, wherein the frame has a plurality of longitudinal struts and a plurality of transverse struts running plane-parallel to one another, wherein the longitudinal struts and the transverse struts are arranged substantially perpendicular to one another, and wherein at least one bridging element is arranged between at least two transverse struts running adjacent to one another,
wherein, the bridging element is fixed to two of the plurality of transverse struts such that a handling region of the bridging element, formed between an upper end region and a lower end region of the at least one bridging element, has a greater distance from the front side of the frame than the upper end region and lower end region of the bridging element that are fixed to the transverse struts,
wherein, the transverse struts each have an upper side and a lower side which extend substantially orthogonally to the front side of the frame, wherein the upper end region fixed to the lower side of an upper transverse strut of the two transverse struts and the lower end region fixed to the upper side of a lower transverse strut of the two transverse struts,
wherein the end regions are connected to the transverse struts in one of a positive-fitting or materially bonded manner,
wherein a shape of the bridging element is one of: i) a tube, wherein each tube-shaped bridging element includes at least one moisture outlet opening in a section adjoining the end region, ii) a longitudinally cut tube, iii) or a bent flat material.

14. The formwork panel according to claim 13,
wherein, at least a part of the transverse struts in the upper side and the lower side each has at least one groove which runs in the longitudinal direction of the transverse struts.

15. The formwork panel according to claim 14,
wherein, the grooves, viewed in the cross-section of the respective transverse struts, are arranged axially symmetrically to one another and/or are arranged opposite one another and/or the grooves have at least approximately the same shape when viewed in the cross-section of the respective transverse strut.

16. The formwork panel according to claim 14,
wherein, the grooves extend at least over a partial length or over the entire length of the respective transverse strut and the grooves run in the transverse struts at a uniform distance from the front side of the frame.

17. The formwork panel according to claim 14,
wherein, the grooves run off-center in the upper sides and the lower sides of the respective transverse struts, such that the grooves run closer to a rear side of the frame than to the front side.

18. The formwork panel according to claim 13,
wherein, the upper end region and the lower end region each extend substantially orthogonally to the front side of the frame adjacent to the upper side or the lower side of the transverse strut.

19. A formwork panel, comprising:
a frame on the front side of which a formwork shell can be fixed, wherein the frame has a plurality of longitudinal struts and a plurality of transverse struts running plane-parallel to one another, wherein the longitudinal struts and the transverse struts are arranged substantially perpendicular to one another, and wherein at least one bridging element is arranged between at least two transverse struts running adjacent to one another,
wherein, the transverse struts each have an upper side and a lower side which extend substantially orthogonally to the front side of the frame, wherein the bridging element has an upper end region fixed to the lower side of an upper transverse strut of the two transverse struts and the bridging element has a lower end region fixed to the upper side of a lower transverse strut of the two transverse struts,
wherein, at least a part of the transverse struts in the upper side and the lower side each has at least one groove which runs in the longitudinal direction of the transverse struts, wherein, the grooves, viewed in the cross-section of the respective transverse struts, are one of: i) arranged axially symmetrically to one another, ii) arranged opposite one another, or iii) the grooves have at least approximately the same shape when viewed in the cross-section of the respective transverse strut,
wherein, the upper end region and the lower end region of the bridging element are fixed to contact regions of the upper side and the lower side located between the grooves and the front side of the frame,
wherein the end regions are connected to the transverse struts in one of a positive-fitting or materially bonded manner,
wherein a shape of the bridging element is one of: i) a tube, wherein each tube-shaped bridging element includes at least one moisture outlet opening in a section adjoining the end region, ii) a longitudinally cut tube, iii) or a bent flat material.

20. The formwork panel according to claim 19, wherein the grooves are positioned off-center in the upper side and the lower side of the transverse struts such that a distance between the grooves and a front edge of the transverse strut is greater than a distance between the grooves and a rear edge of the transverse strut, wherein a connecting component is fixable in the grooves.

21. The formwork panel according to claim 19, wherein ends of the upper end region and the lower end region lying in a plane with the front side of the frame.

* * * * *